US011383284B2

(12) United States Patent
Sundquist et al.

(10) Patent No.: US 11,383,284 B2
(45) Date of Patent: Jul. 12, 2022

(54) PRESS BRAKE TOOL ENGAGEMENT SYSTEM

(71) Applicant: MATE PRECISION TOOLING, INC., Anoka, MN (US)

(72) Inventors: Dean Sundquist, Plymouth, MN (US); Christopher Morgan, Minneapolis, MN (US); Joe Schneider, Elk River, MN (US)

(73) Assignee: Mate Precision Technologies Inc., Anoka, MN (US)

( * ) Notice: Subject to any disclaimer, the term of this patent is extended or adjusted under 35 U.S.C. 154(b) by 473 days.

(21) Appl. No.: 15/698,395

(22) Filed: Sep. 7, 2017

(65) Prior Publication Data

US 2018/0071805 A1 Mar. 15, 2018

Related U.S. Application Data

(60) Provisional application No. 62/385,513, filed on Sep. 9, 2016.

(51) Int. Cl.
*B21D 5/02* (2006.01)
*B21D 37/04* (2006.01)
*B21D 55/00* (2006.01)

(52) U.S. Cl.
CPC ..... *B21D 5/0254* (2013.01); *B21D 5/0236* (2013.01); *B21D 37/04* (2013.01); *B21D 55/00* (2013.01)

(58) Field of Classification Search
CPC ..... B21D 5/0236; B21D 37/02; B21D 37/04; B21D 3/15; B21D 5/0209; B21D 5/0254; B29D 5/0236; B29D 5/0254
See application file for complete search history.

(56) References Cited

U.S. PATENT DOCUMENTS

| | | | |
|---|---|---|---|
| 2,082,210 | A | 6/1937 | Mcmaster |
| 2,912,249 | A | 11/1959 | Eckold |
| 3,377,887 | A | 4/1968 | Nelson et al. |
| 3,451,236 | A | 6/1969 | Fowler et al. |
| 3,907,452 | A | 9/1975 | Tripp |
| 4,135,770 | A | 1/1979 | Doherty et al. |

(Continued)

FOREIGN PATENT DOCUMENTS

| | | | |
|---|---|---|---|
| AT | 515526 A4 * | 10/2015 | ..... B21D 5/0254 |
| AT | 515526 T | 10/2015 | |

(Continued)

OTHER PUBLICATIONS

Brisard, FR2791590A1 Translation, Oct. 2000, espacenet.com (Year: 2000).*

(Continued)

*Primary Examiner* — Gregory D Swiatocha
*Assistant Examiner* — Bobby Yeonjin Kim
(74) *Attorney, Agent, or Firm* — Dorsey & Whitney LLP

(57) ABSTRACT

A press brake tool comprises a tool body having a working end configured for operation on a workpiece and a coupling end configured for engagement with a tool holder. The working end is disposed along the tool body, generally opposite the coupling end. One or more magnetic elements can be configured to induce a magnetic coupling for selective engagement and disengagement of the coupling end of the tool body with the tool holder.

27 Claims, 32 Drawing Sheets

(56) References Cited

U.S. PATENT DOCUMENTS

| | | | | |
|---|---|---|---|---|
| 4,197,772 | A | 4/1980 | Anderson et al. | |
| 4,787,237 | A | 11/1988 | Houston et al. | |
| 4,805,439 | A | 2/1989 | Kobayashi et al. | |
| 5,595,560 | A | 1/1997 | Kamada | |
| 5,782,308 | A | 7/1998 | Latten et al. | |
| 5,794,486 | A | 8/1998 | Sugimoto et al. | |
| 6,003,360 | A * | 12/1999 | Runk | B21D 5/0236 72/389.3 |
| 6,557,390 | B2 | 5/2003 | Runk et al. | |
| 6,848,291 | B1 * | 2/2005 | Johnson | B21D 5/0209 72/481.1 |
| 6,928,852 | B2 | 8/2005 | Enderink | |
| 7,069,766 | B2 | 7/2006 | Hayashi et al. | |
| 7,260,974 | B2 | 8/2007 | Koch et al. | |
| 8,752,410 | B2 | 6/2014 | Rogers et al. | |
| 10,399,133 | B2 | 9/2019 | Felder | |
| 2006/0174680 | A1 * | 8/2006 | Shimota | B21D 5/0209 72/481.2 |
| 2007/0144232 | A1 | 6/2007 | Shimota et al. | |
| 2011/0247389 | A1 | 10/2011 | Rouweler et al. | |
| 2013/0019650 | A1 | 1/2013 | Rogers et al. | |
| 2015/0143867 | A1 | 5/2015 | Sato et al. | |
| 2017/0066032 | A1 | 3/2017 | Jarrier | |
| 2017/0144206 | A1 | 5/2017 | Felder | |
| 2017/0232493 | A1 | 8/2017 | Denkmeier et al. | |
| 2017/0297073 | A1 | 10/2017 | Sato | |
| 2018/0304331 | A1 | 10/2018 | Cavicchia et al. | |
| 2019/0001387 | A1 | 1/2019 | Sundquist et al. | |
| 2019/0134691 | A1 | 5/2019 | Sundquist et al. | |

FOREIGN PATENT DOCUMENTS

| | | | | |
|---|---|---|---|---|
| CN | 87213856 | U | 6/1988 | |
| DE | 3729808.9 | C2 | 6/1995 | |
| DE | 19928831 | A1 | 12/2000 | |
| DE | 202015004582.0 | U1 | 8/2015 | |
| EP | 0387121 | A1 | 9/1990 | |
| EP | 1321200 | A2 | 6/2003 | |
| EP | 1479461 | A1 | 5/2004 | |
| EP | 1 321 200 | B1 | 3/2008 | |
| EP | 2946847 | A1 | 11/2015 | |
| FR | 2791590 | A1 | 3/1999 | |
| FR | 2791590 | A1 * | 10/2000 | B21D 5/0209 |
| FR | 2791590 | A1 | 10/2000 | |
| JP | S6363530 | A | 3/1988 | |
| JP | 2002086298 | A | 3/2002 | |
| WO | 2016023057 | A1 | 2/2016 | |
| WO | 2017067879 | A1 | 4/2017 | |
| WO | WO2018049056 | A1 | 3/2018 | |

OTHER PUBLICATIONS

Notification of Transmittal of the International Search Report and the Written Opinion of the International Searching Authority, or the Declaration (PCT/US2018/059407) dated Jan. 15, 2019 (10 pages).

Notification of Transmittal of the International Search Report and the Written Opinion of the International Searching Authority, or the Declaration (PCT/US2018/039931) dated Nov. 7, 2018 (14 pages).

International Search Report and Written Opinion of the International Searching Authority for International Patent Application No. PCT/US2017/050524, dated Dec. 1, 2017 (14 pages).

Written Opinion of the International Preliminary Examining Authority for International Patent Application No. PCT/US2018/039931, dated Jul. 12, 2019 (6 pages).

"Ferromagnetism", Hyperphysics website (Georgia State University), 2000.

"Magnetic Squaring Arm," Wilson Tool, available at <www.wilsontool.com>, 3 pages (Aug. 19, 2016).

"Quick die clamping: hydraulic, magnetic, or hydromechanical?" Stamping Journal, obtained from <https://www.thefabricator.com/stampingjournal/article/stamping/quick-die-clamping-hydraulic-magnetic-or-hydromechanicalr>, 8 pages (Jun. 13, 2012).

Communication pursuant to Article 94(3) EPC dated May 16, 2022 in connection with European patent application No. 17768929.6, 6 pages.

* cited by examiner

DETAIL K

DETAIL H

DETAIL H

SECTION A-A

SECTION B-B

SECTION A-A

SECTION B-B

PRESS BRAKE TOOL ENGAGEMENT SYSTEM

CROSS-REFERENCE TO RELATED APPLICATION

This application claims benefit under 35 U.S.C. § 119 to the earlier filing date of U.S. Provisional Application No. 62/385,513, filed Sep. 9, 2016, entitled PRESS BRAKE TOOL SAFETY MECHANISM, which is incorporated by reference herein, in its entirety and for all purposes.

BACKGROUND

Press brake tool systems are used for forming sheet metal and other workpieces, and commonly include an upper table and a lower table. The upper table can be equipped to move vertically with respect to the lower table. Various forming tools can be mounted to the tables, so that when the tables are brought together, the tools bend or impress a workpiece, such as a piece of sheet metal, placed therebetween.

Typically, the upper table will couple with male forming tools, such as press brake and punch tools, and the bottom table will couple with female forming tools, such as dies. In order to perform a variety of forming operations, differently shaped press brake tools and dies are used. Thus, it is often necessary to exchange various forming tools within both the upper table and lower table.

Because the forming tools mounted in the lower table are supported from below, they may be substituted with relative ease. The forming tools mounted to the upper table, however, are suspended from above, usually held in place by a clamping mechanism that clamps all of the forming tools simultaneously. Upon loosening, unlocking, or releasing the clamping mechanism, the forming tools mounted to the upper table may be removed by sliding the tools horizontally to an open end of the upper table, or in some instances, by removing the tools vertically. Horizontal exchange of the forming tools can be cumbersome due to the proximity of the forming tools with respect to one another in the upper table, often necessitating the removal of each tool mounted within the upper table when only one tool is being exchanged. Neighboring clamps may also interfere with horizontal removal of the tools.

Vertical removal and insertion of the forming tools may not improve the exchange process due to the safety risks associated with handling the often heavy forming tools. In particular, loosening the clamping mechanism of the upper table may result in one or more tools falling and injuring a press brake operator.

To prevent the forming tools from accidentally falling from the upper table of a press brake assembly, several safety mechanisms have been developed. One such mechanism may involve a safety tang that protrudes laterally from a surface of the forming tool. Such a safety tang may be shifted into a complementary groove defined by a tool holder in the upper table, thereby securing the tool to the holder until the tool is clamped. This mechanism is problematic, however, because of the manipulation required of the user to actuate the safety mechanism and secure the tool within the holder. Other preexisting safety mechanisms that involve forming tools equipped with a variety of latches, straps, or projections and complementary receiving spaces defined by tool holders are deficient for similar reasons. These designs typically employ a variety of movable external parts and often require a high degree of structural specificity between the design of each forming tool and corresponding tool holder.

Thus, there exists a need for improved mechanisms used to secure forming tools to the upper table of a press brake assembly while the clamping mechanism of such an assembly is disengaged, such that heavy forming tools can be quickly exchanged without the risk of accidentally falling.

SUMMARY

A tool includes a magnetic safety mechanism for operation in a press brake or similar machine apparatus. The mechanism includes a coupling assembly configured to provide a releasable magnetic coupling between the tool and a tool holder. A release is provided to selectively engage and disengage the magnetic coupling with the tool holder, alternately coupling and releasing the tool from the press assembly.

DETAILED DESCRIPTION

Figure 1A:
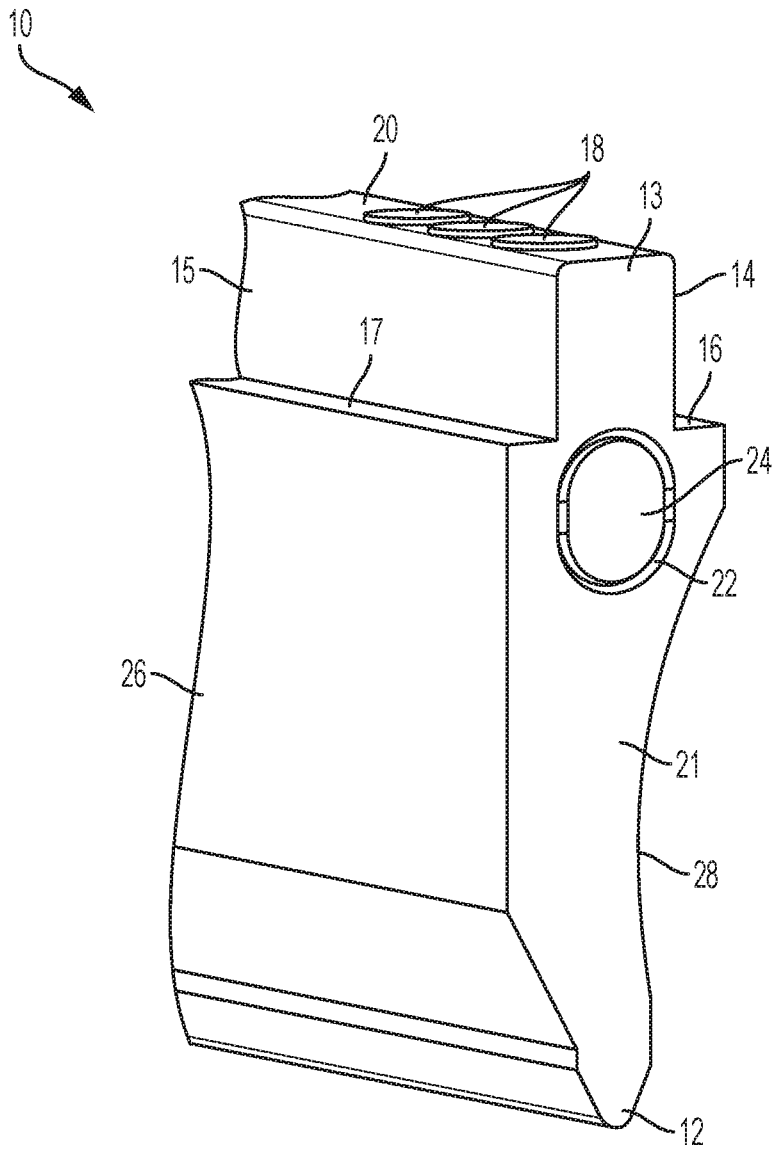
FIG. 1A is an isometric view of a tool for a press brake apparatus.

FIG. 1A is an isometric view of a tool component 10 for a press brake machine or similar press-type machine apparatus. While generally described as a press brake tool herein, component 10 may alternately be configured as a press brake punch, punch tool, or similar machine tool component.

As shown in FIG. 1A, tool 10 includes a tool end or working end 12 opposite a coupling end or tang 13. Depending on the particular configuration of tool 10, working end 12 may be generally positioned beneath coupling end or tang 13, such that working end 12 is the bottom end and coupling end or tang 13 is the top end. Tang 13 may be mounted within a corresponding tool holder as part of a press brake assembly. In operation, such a press brake assembly may punch, impress, crimp, fold, crease, or otherwise shape various workpieces inserted beneath working end 12 and optionally one or more forming dies. In some examples, a workpiece may include a sheet metal component or other material to be tooled.

In these examples, tool 10 may include two load-bearing shoulder portions 16, 17 that extend horizontally outward from reference faces 14, 15 at the base of tang 13. Shoulder portions 16, 17 may contact complementary surfaces on a tool holder upon inserting tool 10 within the holder, in order to bear or transfer a load between the tool holder and the tool body upon operation of the working end on a sheet metal component or other workpiece.

Tool 10 also includes a plurality of magnetic assemblies 18 vertically disposed within tang 13 and tool body 21. Each magnetic assembly 18 may include one or more magnetic elements, which may include one or more permanent magnets, ferromagnetic components, or combinations thereof. As illustrated, each magnetic assembly 18 may be partially exposed through a top surface 20 of tang 13. In this particular example, tool 10 includes three magnetic assemblies 18. In other examples, the number of magnetic assemblies 18 in a given tool 10 may vary, ranging from 1 to about 50 magnetic assemblies 18. Each magnetic assembly 18 may be removable, adjustable, or fixed within tool 10.

The body 21 of tool 10 may include front and back surfaces 26 and 28. In examples, surfaces 26, 28 may be variously shaped and sized depending on the desired function of tool 10. Tool 10 may further define a lateral cavity 22, of which only the opening is visible in FIG. 1A. Lateral cavity 22 may be configured to slidably receive an armature 24, which is shown fully inserted within the lateral cavity in FIG. 1A. In the embodiment shown, armature 24 provides a coupling mechanism configured to modulate the strength of a magnetic flux coupling induced between tool 10 and the holder. In some examples, armature 24 can be adapted for selective disengagement of the coupling end or tang 13 of tool 10 from the holder. Armature 24 contains one or more dynamic or moving elements, which can include one or more magnetic elements, e.g., permanent magnets and/or ferromagnetic components.

Once inserted into the receiving space defined by a tool holder, tool 10 may be held in place at least temporarily by magnetic forces prior to clamping tool 10 with the holder. In particular, the magnetic elements of magnetic assemblies 18 and armature 24 may align such as to guide a magnetic flux in a circuit further involving a ferromagnetic material, e.g., medium alloy steel, comprising the tool holder. The magnetic flux can urge tool 10 upwardly into the tool holder so as to minimize non-ferromagnetic gaps, e.g., air gaps, between the two components, thus holding tool 10 up against the load-impinging shoulder surfaces of the holder. In some examples, the magnetic flux coupling induced between tool 10 and its tool holder can support the weight of the tool without additional clamping support. By holding tool 10 in place prior to clamping a tool holder around the upper portion of tool 10, a user's hands may be free to install additional tools until the holder is activated to lock all tools in place for operation on a workpiece. In some embodiments, the strength of the magnetic flux coupling can secure tool 10 even during operation on a workpiece without additional clamping support.

Figure 1B:
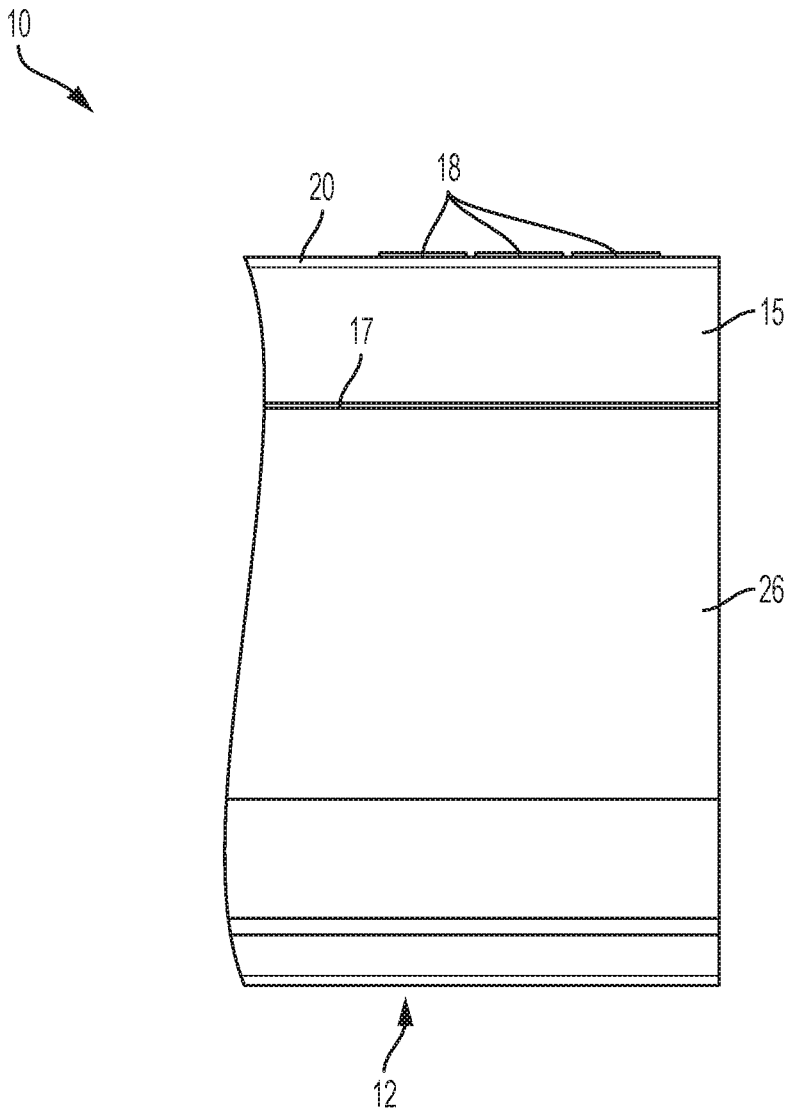
FIG. 1B is a front view of the tool.

FIG. 1B is a front view of tool 10. As illustrated in FIG. 1B, magnetic assemblies 18 may protrude a distance above top surface 20. The distance by which magnetic assemblies 18 protrude above top surface 20 may vary.

Press brake tool system or apparatus 10 includes a tool body 21 with a working end configured for operation on a workpiece, and a coupling end configured for selective engagement with a tool holder. The working end is spaced from the coupling end along the tool body, e.g. at opposite top and bottom ends. One or more magnetic assemblies 18 can be configured to induce a magnetic coupling between the tool body 21 and the tool holder, where the coupling end of the tool body is magnetically engageable with the tool holder.

The magnetic assemblies 18 can include one or more magnets disposed in the tool body 21 for generating magnetic flux to induce the magnetic coupling, one or more ferromagnetic components disposed in the tool body 21 for guiding magnetic flux to induce the magnetic coupling, or a combination thereof. Typically, the magnetic coupling is sufficient to support the weight of the tool body 21 upon engagement of the coupling end with the tool holder.

Figure 1C:
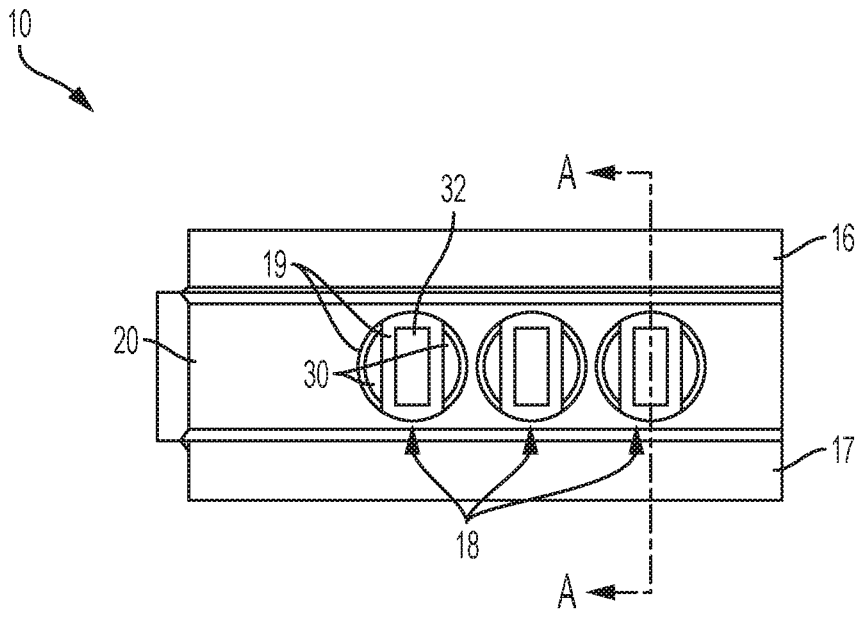
FIG. 1C is a top view of the tool.

FIG. 1C is a top view of tool 10, showing each of the three magnetic assemblies 18 included in this particular example. In other examples, the number, spacing, and arrangement of magnetic assemblies 18 within tool 10 may vary. As shown in FIG. 1C, each magnetic assembly 18 may include two assembly slugs 30 laterally flanking each side of an end guide 32. Assembly slugs 30 and end guide 32, along with other components of each magnetic assembly 18, may be contained within a housing 19, which can be fixed within tool 10. In some examples, such components may be cast or mold into housing 19 to form each magnetic assembly 18. Housing 19 may be a structural insert that defines the external shape of each magnetic assembly 18 and its internal compartments. Such an insert may be made from various materials including but not limited to one or more plastics or polymer compositions.

In embodiments, the number of assembly slugs 30 and end guides 32 may vary. Each assembly slug 30 may be made from various materials including but not limited to a magnetically permeable material, e.g., one or more metals such as steel. In some examples, such magnetically permeable material may be highly permeable. End guides 32 may also be made from various materials including but not limited to iron or steel, e.g., electrical steel. FIG. 1C also shows line A-A, which denotes a cross-sectional plane used for illustration purposes.

Figure 1D:
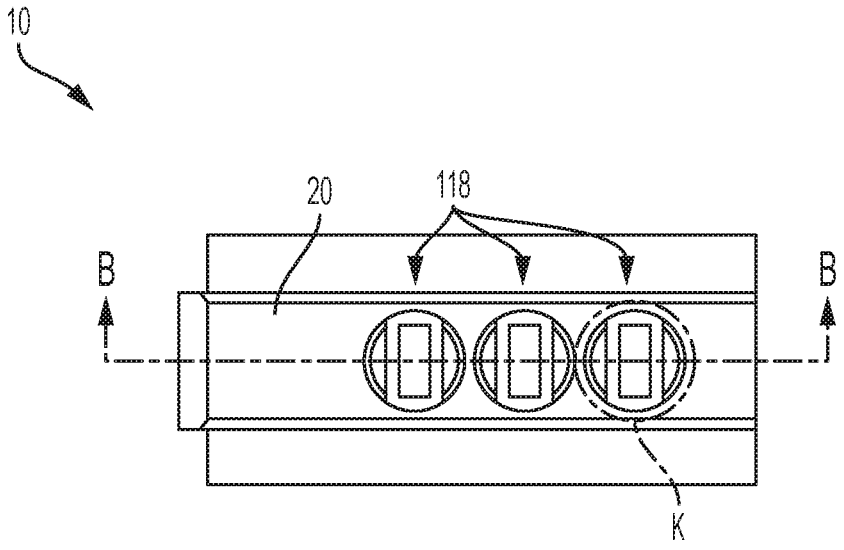
FIG. 1D is an alternate top view of the tool.

FIG. 1D is an alternate top view of tool 10, showing three magnetic assemblies 18 exposed at one end through top surface 20. FIG. 1D also shows line B-B, which denotes a cross-sectional plane, and detail K, used for illustration purposes.

The magnetic assemblies 18 can include one or more permanent magnets disposed in the tool body 21, and configured to form a magnetic coupling between the tool body and the tool holder with the coupling end of the tool body 21 is engaged. One or more non-ferromagnetic components can also be disposed in the tool body, and adapted for modulation of a flux path through the one or more magnetic elements (e.g., where the strength of the magnetic coupling is responsive to the modulation of the flux path). Similarly, a plurality of magnetic sub-assemblies 18 may each include one or more magnets, ferromagnetic elements or non-ferromagnetic components configured to independently induce a magnetic coupling between the coupling end of the tool body 21 and the tool holder.

A tang 13 can be defined by the coupling end of the tool body, and adapted for the selective engagement with the tool holder. One or more magnets or ferromagnetic components can be disposed in the tang 13, and configured to induce the magnetic coupling by generating or guiding magnetic flux between the tang 13 and the tool holder.

One or more load-bearing shoulders 16, 17 can be defined on the tool body, and configured to bear a mechanical load between the tool holder and the tool body for operation of the working end of the tool body 21 on a workpiece. One or more magnets or ferromagnetic components can also be disposed in the load-bearing shoulder 16, 17, and configured to induce the magnetic coupling by generating or guiding magnetic flux between the load-bearing shoulder 16, 17 and the tool holder.

Figure 1E:
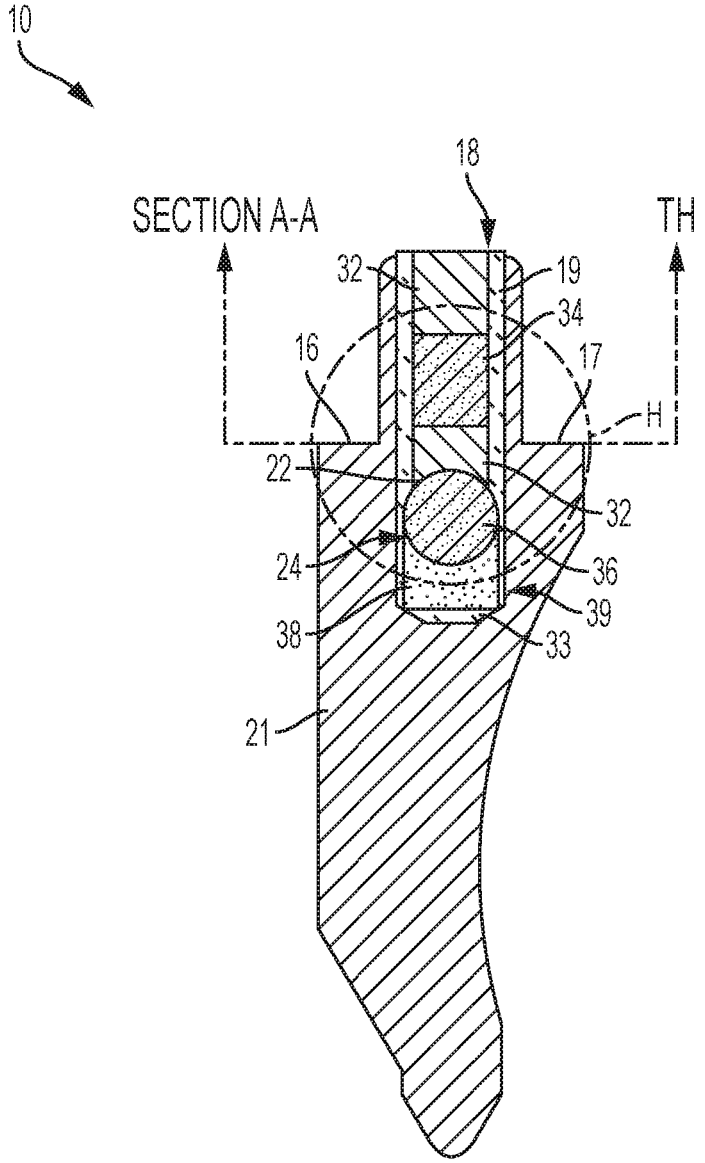
FIG. 1E is a section view of the tool, taken along line A-A of FIG. 1C.

FIG. 1E is a section view of tool 10, taken along line A-A of FIG. 1C. This section view illustrates the inner portion of a magnetic assembly 18 and armature 24 inserted therethrough, each component positioned within tool 10. As shown in this particular view, magnetic assembly 18 can include an assembly magnet 34, multiple end guides 32 and a return flux guide or loop component 38, each contained within housing 19. Armature 24 can include an armature magnet 36. FIG. 1E also shows an outline of the bottom portion of an exemplary tool holder TH (dashed lines) with which tool 10 may be magnetically coupled and clamped into a press brake machine or similar machine apparatus. In various embodiments, tool holder TH can be a preexisting, conventional tool holder lacking discrete magnetic components and made of steel, for example.

In some examples, assembly magnet 34 may comprise a permanent magnet made from one or more magnetic materials, e.g., neodymium iron boron ("NdFeB"). Assembly magnet 34 may be a bar magnet.

In the particular configuration of FIG. 1E, armature magnet 36 is included within armature 24 and positioned beneath assembly magnet 34 when armature 24 is inserted within lateral cavity 22. Like assembly magnet 34, armature magnet 36 may also be a permanent magnet made of NdFeB. In some embodiments, armature magnet 36 may be made of other magnetic materials. Armature magnet 36 may be magnetized diametrically and oriented such that the north pole of armature magnet 36 is in closest proximity to the south pole of assembly magnet 34.

In the example of FIG. 1E, end guides 32 are positioned above assembly magnet 34, and between assembly magnet 34 and armature magnet 36. In some examples, end guides 32 may be made from various materials including but not limited to one or more metals, e.g., iron or electrical steel.

Return flux guide 38 is positioned beneath armature magnet 36 in this example, and is also contained within housing 19 as a sub-component of magnetic assembly 18. Return flux guide 38 may comprise a magnetically permeable material. In some examples, such material may be highly permeable.

In the example depicted in FIG. 1E, magnetic assembly 18 extends downward through tang 13 and into a vertical cavity 39 defined by tool body 21 to a distance below the horizontal plane of shoulders 16, 17. The distance by which each vertical magnetic assembly 18 extends within tool 10 may vary and may depend on the shape, weight, and/or size of tool 10, the number of magnetic assemblies 18 included within a given tool 10, and/or the configuration of the tool holder into which tool 10 is inserted. As further shown, an air gap 33 may be defined beneath the bottom-most surface of flux guide 38 in magnetic assembly 18, at the bottom of vertical cavity 39. In these examples, gap 33 may contribute to a desired magnetic flux direction induced by tool 10 and the holder by providing a non-ferromagnetic component positioned to modulate the magnetic flux coupling, e.g., by guiding the magnetic flux or by modifying or disrupting the flux path.

Figure 1F:
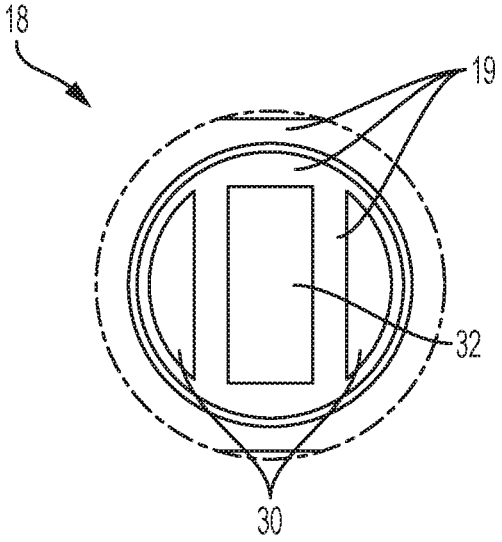
FIG. 1F is a top view of a magnetic coupling assembly for the tool, taken at detail K in FIG. 1D.

FIG. 1F is a top view of a vertical magnetic assembly 18, taken at detail K in FIG. 1D. Detail K illustrates a magnified view of the top of each magnetic assembly 18. As in FIG. 1F, each magnetic assembly may include two D-shaped assembly slugs 30 and an end guide 32 exposed at top surface 20. Housing 19, also visible at top surface 20, may laterally partition assembly slugs 30 and end guide 32.

Figure 1G:
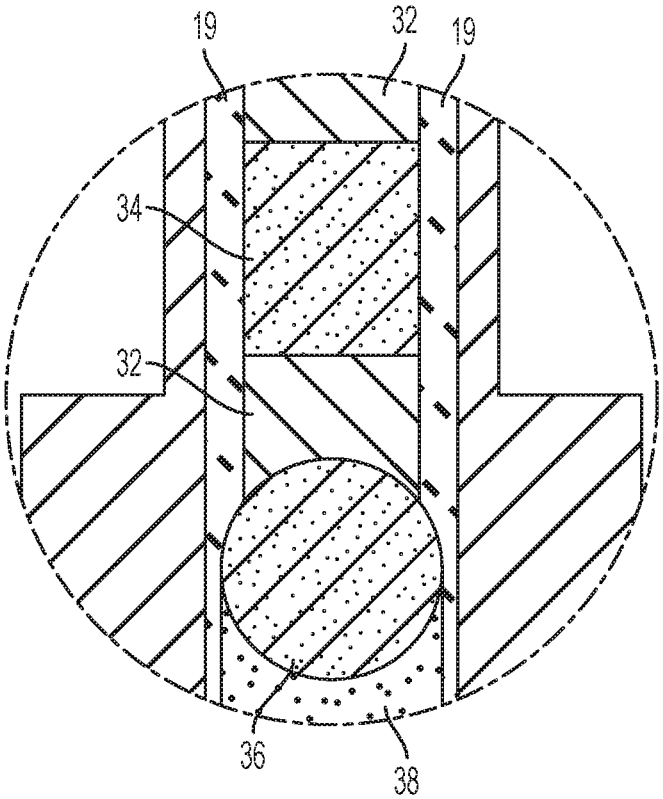
FIG. 1G is a section view of the tool, taken at detail H of FIG. 1E and along line A-A of FIG. 1C.

FIG. 1G is a section view of detail H taken along section A-A. As shown in FIG. 1G, assembly magnet 34 may define an approximately rectangular cross-sectional shape, and armature magnet 36 may define an approximately circular cross-sectional shape. In other examples, the shape of each magnet may vary. The cross-sectional width of each wall of housing 19 may also vary. In this particular embodiment, the cross-sectional width of each exterior wall of housing 19 may be the greatest near top surface 20.

Figure 2:
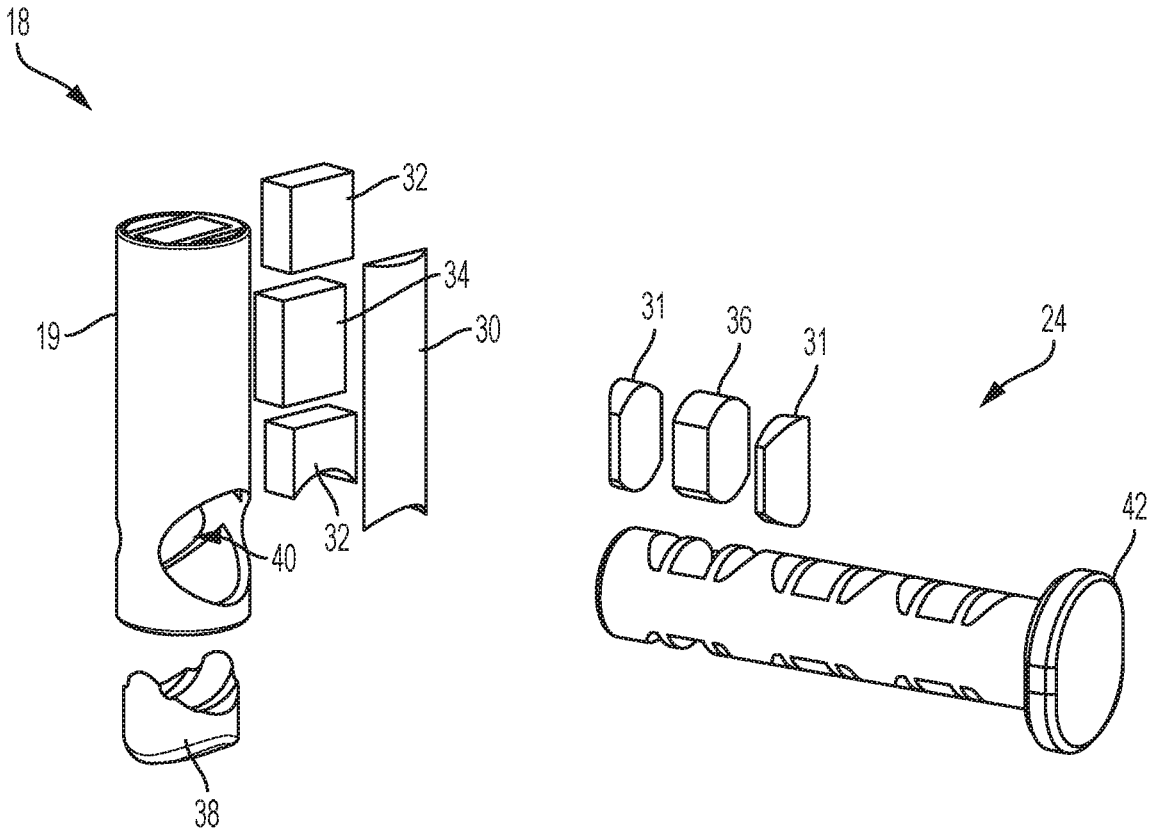
FIG. 2 is an exploded view of the magnetic coupling assembly and an armature.

FIG. 2 is an exploded view of a magnetic assembly 18 and armature 24. In this example, magnetic assembly 18 defines an aperture 40 configured to slidably receive armature 24 such that magnetic assembly 18 and armature 24 intersect. As shown, aperture 40 may define a lateral through-hole. Aperture 40 may align with lateral cavity 22 of tool 10, such that armature 24 is configured to slide seamlessly through aperture 40 and tool 10.

As further shown in FIG. 2, the sub-assemblies of magnetic assembly 18 and armature 24 may include numerous distinct components. In particular, assembly magnet 34, return flux guide 38, each end guide 32, and each assembly slug 30 may be separate sub-components of each magnetic assembly 18, arranged to generate a magnetic circuit upon assembly with armature 24 and insertion within a tool holder. Housing 19 may define one or more internal compartments for containing each of the internal components of magnetic assembly 18. In this embodiment, housing 19 is cylindrical, but the shape of housing 19 may vary in other examples.

Each armature 24 can include a plurality of dynamic elements, such as armature magnets 36, which can be permanent magnets in various embodiments. In this particular example, armature 24 includes three armature magnets 36 each flanked by a pair of D-shaped armature slugs 31. The armature slugs 31 can comprise ferromagnetic wedges. When inserted within tool 10, armature magnets 36 and slugs 31 can align with the magnetic elements included within each magnetic assembly 18. In embodiments, armature 24 can include one or more permanent magnets, electromagnets, ferromagnetic components, and/or non-ferromagnetic components collectively arranged to strengthen or support a magnetic circuit between tool 10 and the holder. Armature 24 may further include an end portion 42 that may be manually engaged by a user of tool 10 to insert and remove armature 24 therefrom. In some examples, end portion 42 may comprise a handle, knob, protrusion, or other feature graspable by a user.

Figure 3A:
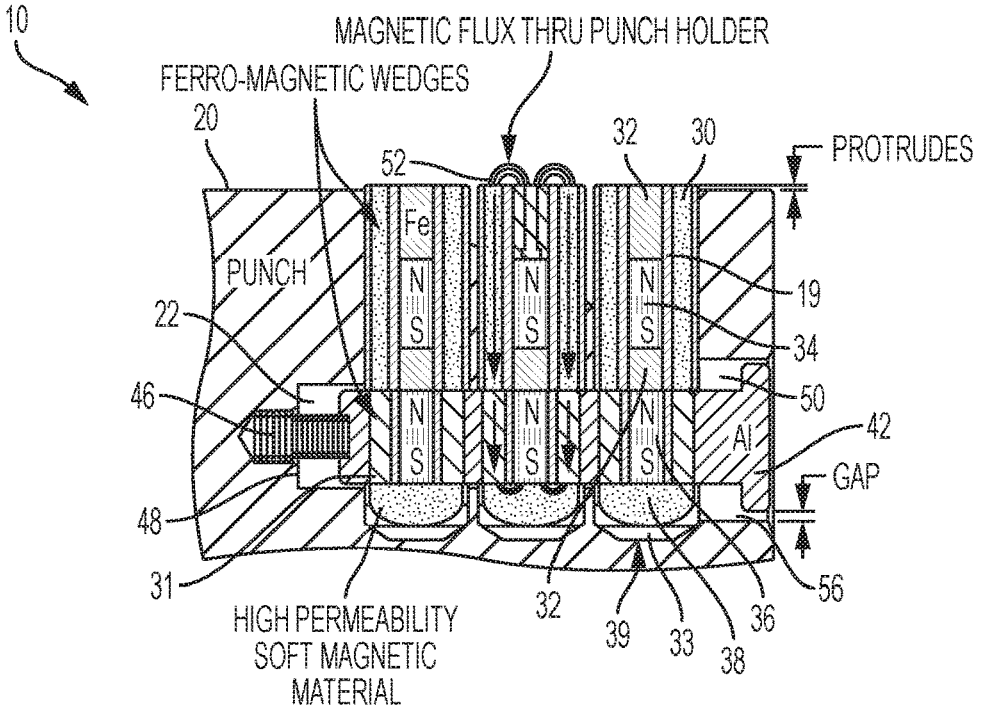
FIG. 3A is a section view of the tool, taken along line B-B of FIG. 1D.

FIG. 3A is a section view of tool 10, taken along line B-B of FIG. 1D. In this example, tool 10 may define an internal lateral cavity 22 configured to slidably receive armature 24. A bias member 46, e.g., a spring, may be secured at a stop end 48 of cavity 22, protruding laterally within cavity 22 such that armature 24 contacts bias member 46 upon insertion into cavity 22. Cavity 22 may define a receiving end 50 positioned opposite stop end 48. Receiving end 50 may define a greater cross-sectional height and/or width to accommodate armature end portion 42.

As further shown in FIG. 3A, assembly slugs 30 may be laterally partitioned from each end guide 32, assembly magnet 34, armature magnet 36, and flux guide 38 by housing 19. An assembly slug 30 and armature slug 31, in combination, may extend vertically from top surface 20 to the top plane of flux guide 38.

Armature 24 may be inserted to various depths within cavity 22. The depth at which armature 24 is inserted may determine whether tool 10 is in an engaged, locked position or a disengaged, unlocked position. In some examples, movement of armature 24 can switch the strength of the magnetic flux coupling between two bi-stable states: an engaged state in which the magnetic flux coupling between tool 10 and the holder is established, and a disengaged state in which the magnetic flux coupling between tool 10 and the holder is diminished or absent. FIG. 3A depicts the locked position, in which armature 24 contacts, but may not compress, bias member 46. Accordingly, the locked position may represent a relaxed position. In this configuration, armature 24 functions as a button that can be manually pressed to various depths within cavity 22 by exerting various amounts of lateral force against armature end portion 42. As shown in the locked position of FIG. 3A, armature end portion 42 is inserted within cavity 22 such that its end surface is flush with the end surface of tool 10.

In the locked position, assembly magnet 34 included in each magnetic assembly 18 may be magnetically oriented the same as each armature magnet 36. In these examples, each assembly magnet 34 is oriented such that its north pole is positioned above its south pole, and each armature magnet 36 is similarly oriented such that its north pole is oriented above its south pole. In this orientation, assembly magnet 34 armature magnet 36, surrounded by the additional ferromagnetic components of tool 10 and its corresponding tool holder, may form a magnetic circuit that generates a magnetic flux 52 that passes vertically through each end guide 32, loops through a ferromagnetic material comprising the tool holder when tool 10 is in the locked position within a receiving space defined by the holder. It may be desirable that magnetic circuit involves the shoulders of the tool holder: first to hold tool 10 firmly against such shoulders so that tool 10 is in an ideal position for clamping by a press brake or similar machine apparatus, and secondly because the gap between the tang 13 and the inside of the holder is designed as clearance and may therefore not be a precise or sufficiently small gap that it could be depended upon to form a reliable part of the magnetic circuit.

After passing through the tool holder, magnetic flux 52 may be guided back down into each assembly slug 30, which, together with each armature slug 31, may function as a ferromagnetic wedge that propagates magnetic flux 52 downward through each magnetic assembly 18. At the bottom of each armature slug 31, magnetic flux 52 may loop horizontally, via return flux guide 38, and back upward through the south pole of armature magnet 36.

As further shown in FIG. 3A, air gaps 33 and 56 may be present at the bottom of each vertical aperture 39 and receiving end 50, respectively. Gaps 33 and 56 may function as non-ferromagnetic gaps to prevent magnetic flux 52 from dissipating within body 21 of tool 10 beneath vertical aperture 39 and receiving end 50, thereby maintaining an upward flux direction.

FIG. 3A also shows that the body of armature 24 may be made from aluminum. In other examples, the body of armature 24 may be made from various different and/or additional materials. In this example, each flux guide 38 is made from a high permeability soft magnetic material. Other magnetic materials may also be suitable, depending upon flux density and other application-specific considerations.

Figure 3B:
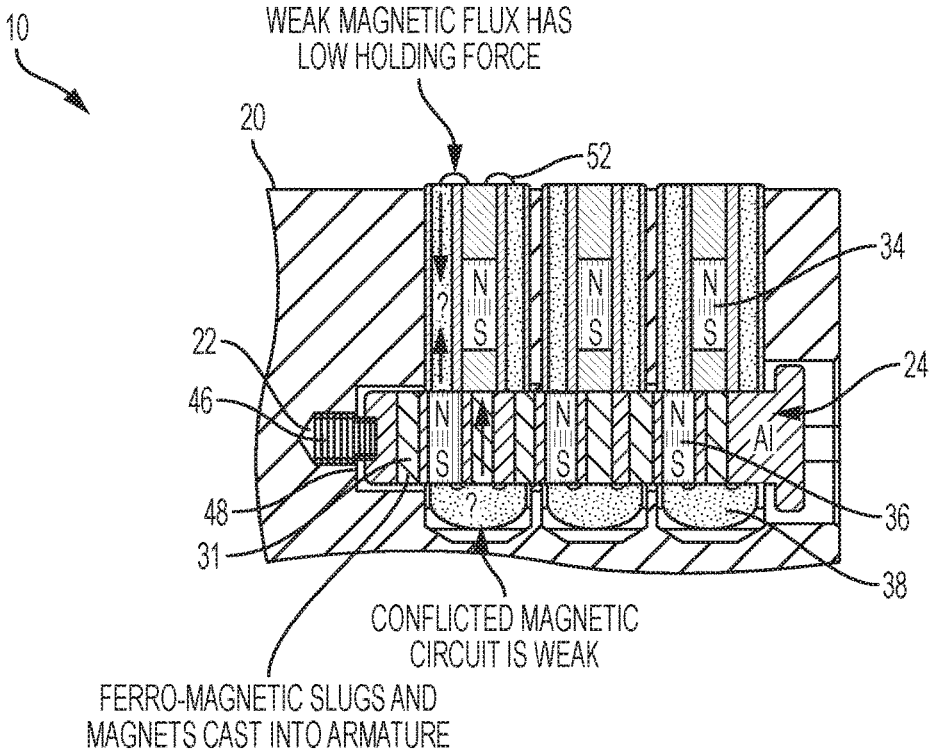
FIG. 3B is an alternate section view of the tool with the coupling assembly in a disengaged configuration, taken along line B-B of FIG. 1D.

FIG. 3B is a section view of tool 10 in an unlocked configuration, taken along line B-B of FIG. 1D. In the unlocked configuration, armature 24 may be urged a greater distance within lateral cavity 22, thereby compressing bias member 46. The magnetic poles of each assembly magnet 34 and armature magnet 36 are misaligned, creating a conflicting, and therefore much weaker, magnetic circuit. The reduced flux 52 generated within such a circuit may reduce the holding force between tool 10 and a corresponding tool holder, allowing manual insertion and removal of tool 10 with respect to the holder. In some examples, gravity alone may cause tool 10, in the unlocked configuration, to fall from a corresponding tool holder.

The release mechanism can include any suitable armature 24 having one or more magnets or ferromagnetic components 36 configured to modulate a strength of the magnetic coupling by motion with respect to the flux path defined by disposition of the one or more magnetic elements 34 in the tool body. The armature 24 can rotate the magnets or ferromagnetic components 36 with respect to the flux path, or with respect to the poles of the magnetic elements 34 defining the flux path. The armature 24 can also be configured for lateral motion of the one or more magnets or ferromagnetic components 36 with respect to the magnetic elements 24 and the flux path defined by the magnetic elements 34. A lever, knob or push button actuator can be engaged with the tool body 21, and mechanically coupled to the magnetic armature 24 for manipulation of the magnets or ferromagnetic elements 36 by the user to modulate the strength of the magnetic coupling. The release mechanism may also comprise a plurality of armature members 24, each having one or more of the magnets or ferromagnetic elements 36 configured to modulate the strength of the magnetic coupling by rotational or lateral motion with respect to one or more flux paths defined by disposition of the one or more magnetic elements 34 of the magnetic assembly 18 within the tool body 21.

Additional Tool Configurations

Figure 4:
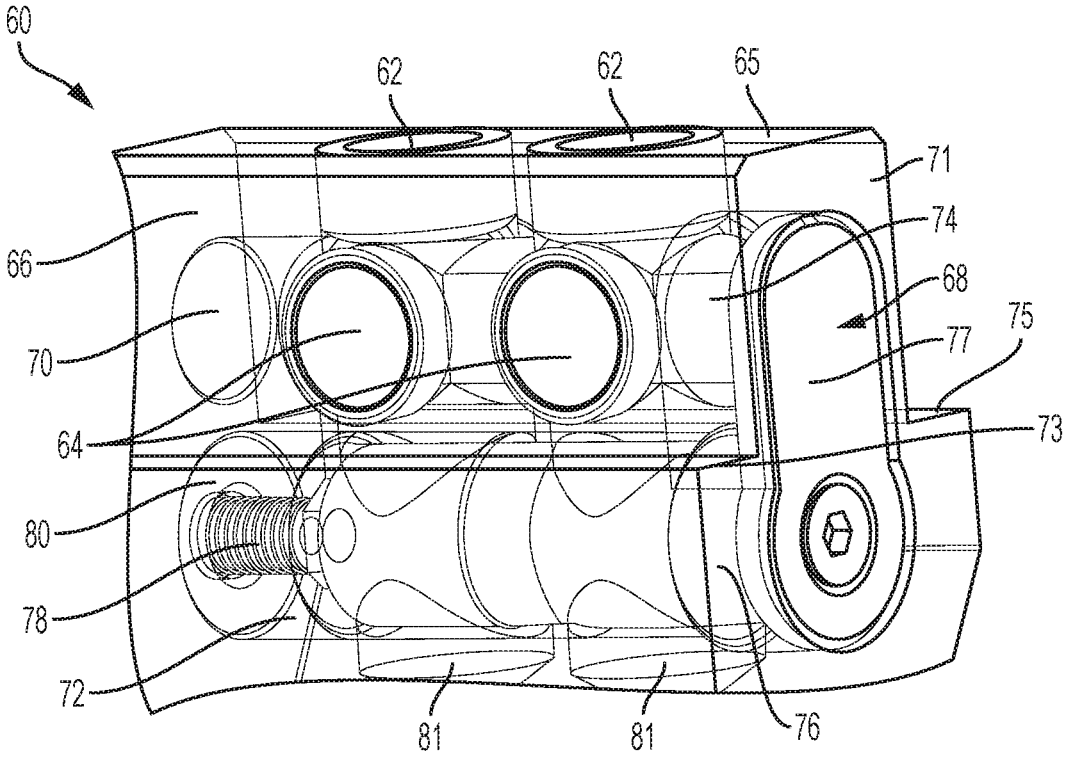
FIG. 4 is an isometric view of a tool for a press brake apparatus, showing the internal configuration with an alternate magnetic coupling configuration.

FIG. 4 is an isometric view of an upper portion of tool 60 for a press brake or similar machine apparatus. As shown in FIG. 4, tool 60 may include a t-shaped magnetic circuit assembly with a sliding armature. The example of FIG. 4 includes two top magnets 62 included within tang 71. A portion of each top magnet 62 may be exposed at the top surface 65 of tool 60. Tool 60 further includes side magnets 64 within tang 71, each exposed at reference face 66.

Top and side magnets 62, 64 can be fixed within tool 60. Each top magnet 62 may be vertically oriented such that its north pole is positioned above its south pole. In some examples, top magnet 62 may be arranged in the opposite polar orientation. Each side magnet 64 may be oriented such that its north pole is positioned on the left side and its south pole on the right side, or vice versa. With respect to the magnetic orientation of top magnets 62, side magnets 64 may thus be oriented in an opposing orientation. Regardless of the specific polar orientation, each side magnet 64 may include a magnetic pole facing the exterior of tool 60, and a magnetic pole facing the interior of tool 60. In any or all of the various examples included herein, the polar orientation of each magnet may be reversed, provided that the polarity of each magnet relative to the other magnets comprising the magnetic circuit remains the same.

Armature 68 can provide a coupling mechanism configured to modulate the strength of the magnetic flux coupling between tool 60 and the holder. Armature 68 is shown inserted within parallel lateral cavities defined by tool 60. In particular, tool 60 includes two lateral cavities: an upper cavity 70 positioned above a lower cavity 72. First or upper arm 74 of armature 68 may be slidably inserted into upper cavity 70, and second arm 76 may be slidably inserted into lower cavity 72. First arm 74 and second arm 76 may be connected at one end by a vertical or transverse armature member 77. While the particular arrangement of upper cavity 70 and/or lower cavity 72 may vary, FIG. 4 illustrates that upper cavity 70 may be defined within tang 71, and lower cavity 72 may be defined below the plane of shoulders 73, 75 that demarcate the lower boundary of tang 71. The exterior surface of transverse member 77 may remain accessible upon insertion of armature 68 within tool 60 such that transverse member 77 may be manually engaged by a user to insert armature 68 within tool 60, and to adjust the lateral depth at which armature 68 extends into tool 60. Upper arm 74 and lower arm 76 of armature 68 can each include one or more dynamic or moving elements, which may include permanent magnets and/or ferromagnetic components.

As further shown in FIG. 4, a bias member 78 may be secured to a stop end 80 defined by lower cavity 72. In this example, bias member 78 comprises a spring. In a locked or engaged configuration, bias member 78 may not be compressed, or may be only slightly compressed, by second arm 76 of armature 68. Tool 60 also includes two vertical cavities 81. In some examples, the number of vertical cavities may vary and may depend on the number of top magnets 62 needed to form a magnetic circuit with armature 68 strong enough to at least temporarily secure tool 60 within a tool holder.

Adjusting the position of armature 68 can modulate the strength of the magnetic flux coupling between tool 60 and the holder. For example, inserting armature 68 to a greater depth within tool 60 by compressing bias member 78 can cause misalignment between the magnetic poles of the dynamic elements of the armature and the magnetic poles of the top magnets 62 and side magnets 64, thus disrupting the magnetic flux coupling between tool 60 and the holder and allowing for release of the tool. By contrast, when the magnetic elements included in armature 68 are magnetically aligned with top and side magnets 62, 64 fixed within tool 60, a magnetic circuit can be established, thereby inducing a magnetic flux guided from tang 71 through reference face 66 into a ferromagnetic shoulder portion of a tool holder coupled with tool 60. Sliding armature 68 in this manner can gradually modulate the strength of the magnetic flux coupling between tool 60 and the holder.

Figure 5:
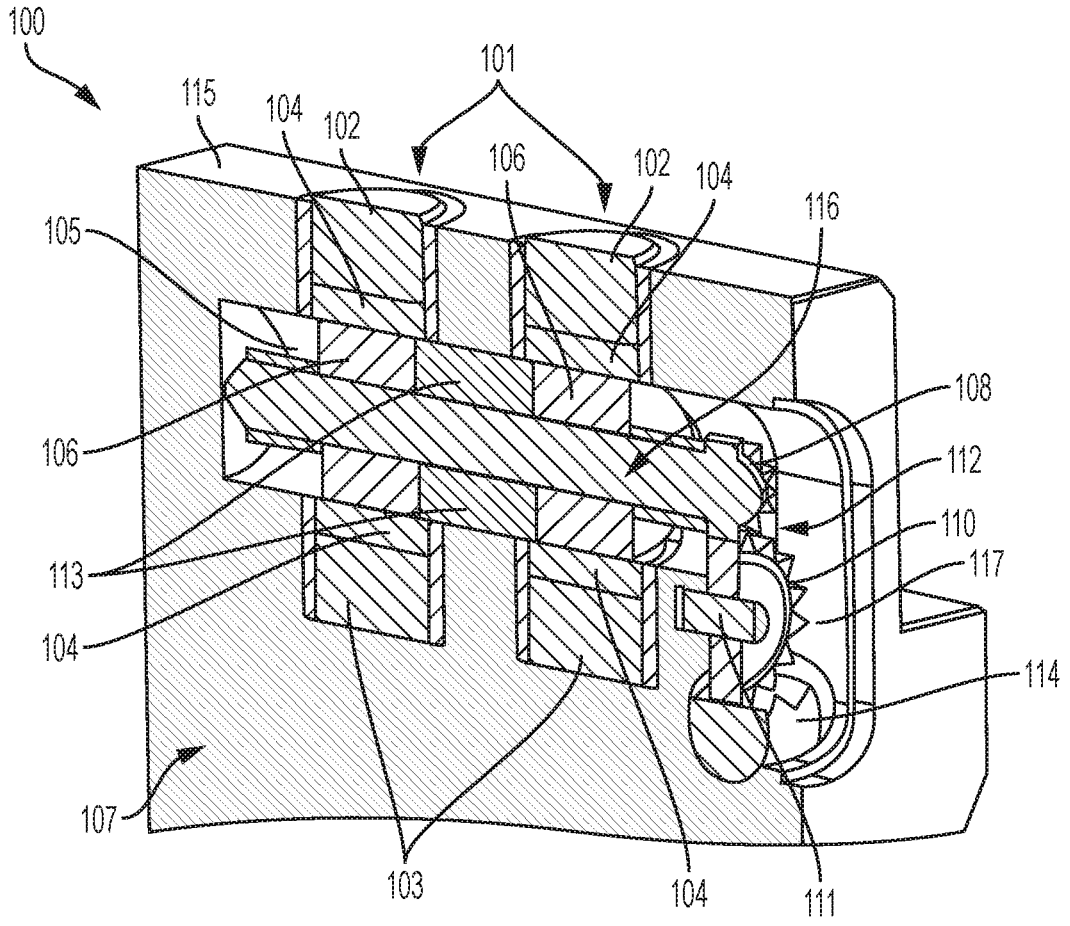
FIG. 5 is an isometric section view of a tool for a press brake apparatus, in an embodiment having an alternate magnetic coupling assembly.

FIG. 5 is an isometric section view of a tool 100 for a press brake or similar machine apparatus, taken along the length or longitudinal direction of tool 100. Tool 100 may include a cross-shaped circuit assembly with a rotating armature. In the particular configuration of FIG. 5, tool 100 includes two vertical magnetic assemblies 101, each assembly 101 including a first magnet 102 and a second magnet 103. First magnet 102 may be exposed at top surface 115, positioned above a lateral cavity 105 defined by tool 100. Second magnet 103 may be positioned below lateral cavity 105. As further shown in the figure, focal wedges 104 may be sandwiched between each first magnet 102 and lateral cavity 105, as well as between each second magnet 103 and lateral cavity 105.

Tool 100 also includes a rotating armature 116, which provides a coupling mechanism configured to modulate the strength of the magnetic flux coupling between tool 100 and the holder. By rotating, armature 116 may adjust the polar orientation of one or more dynamic elements, e.g., permanent disc magnets 106 and ferromagnetic collar 113, contained in the armature and inserted within lateral cavity 105. Rotating the dynamic elements of rotating armature 116 may gradually modulate the strength of the magnetic flux coupling along a spectrum from high strength to low or zero strength. This particular example includes two disc magnets 106 and one ferromagnetic collar 113, but the number of dynamic magnetic components can vary depending upon tool size and application.

As further shown in FIG. 5, tool 100 may also include an upper gear member 108, which includes an elongate body 109 that extends through at least a portion of lateral cavity 105. Upper gear member 108 may rotatably engage an adjacent pinion 110 via a plurality of complementary grooves, or mechanical teeth 117, protruding outward from the perimeter of both gear member 108 and pinion 110. Together, pinion 110 and gear member 108 comprise gear assembly 112. An idler gear 111 may be also positioned at the radial center of pinion 110. Pinion 110 may rotatably engage rack 114 via a plurality of complementary grooves or mechanical teeth also protruding from rack 114.

In operation, lateral movement of rack 114, e.g., sliding, may drive rotation of armature 116. Specifically, lateral movement of rack 114 may cause pinion 110 to rotate, thereby causing rotation of upper gear member 108. Because body 109 of upper gear member 108 is secured within the radial center of each disc magnet 106, rotation of body 109 also drives rotation of each disc magnet 106, thereby adjusting the polarity of each disc magnet 106 with respect to first magnets 102 and second magnets 103.

Figure 6:
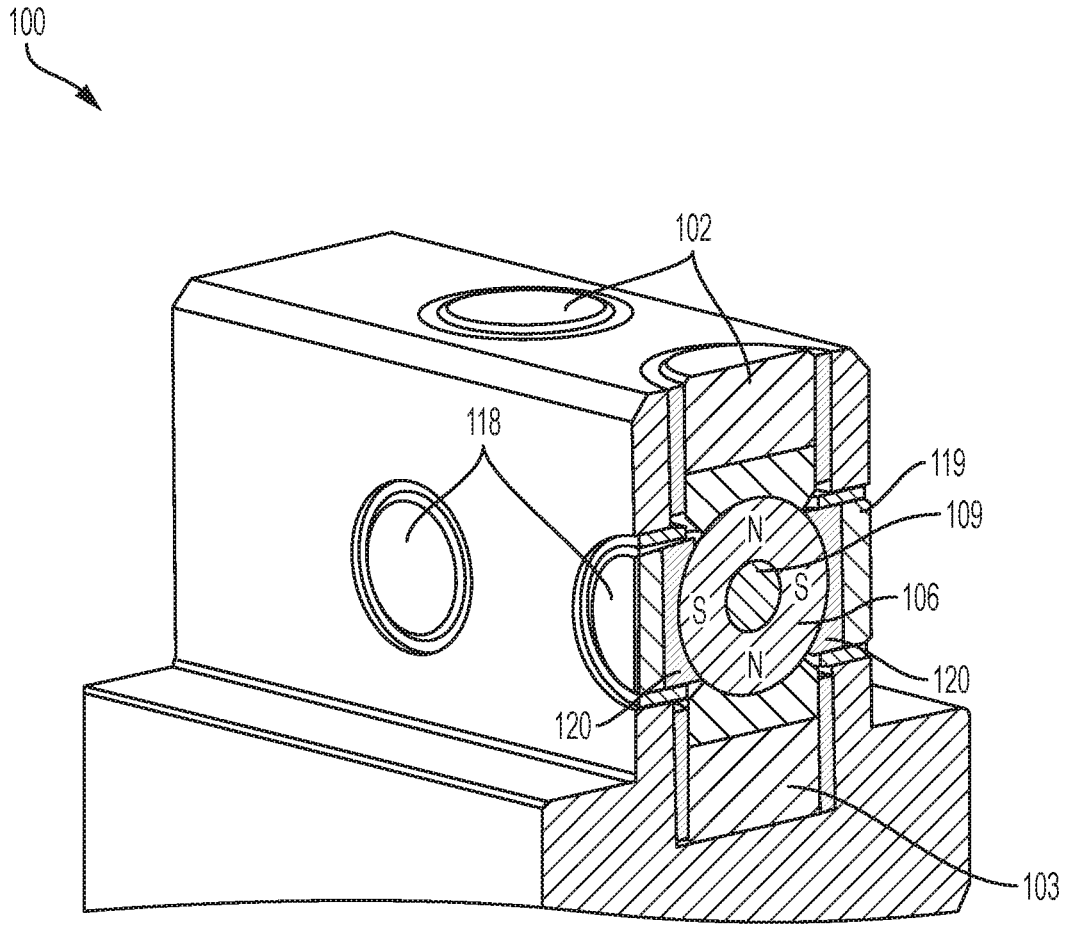
FIG. 6 is an alternate isometric section view of the tool, transverse to FIG. 5.

FIG. 6 is an isometric section view taken along the width of tool 100, transverse to the view of FIG. 5. As further detailed in FIG. 6, tool 100 may include one or more side magnets 118, 119. A lateral focal wedge 120 may be sandwiched between each side magnet 118, 119 and disc magnet 106. In this particular example, disc magnet 106 is magnetized axially such that it includes four magnetic poles.

Figure 7A:
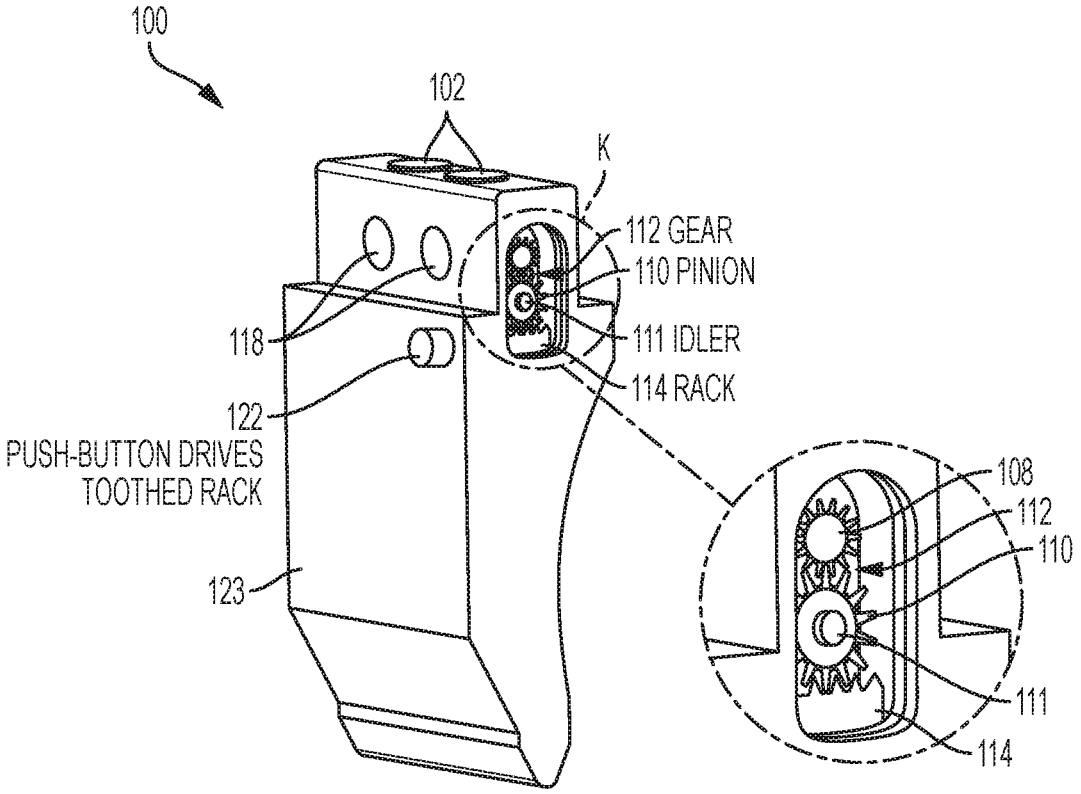
FIG. 7A is an isometric view of the tool of FIG. 5, including a magnetic coupling assembly detail.

FIG. 7A is an isometric view of tool 100. As shown in FIG. 7A, tool 100 may include an exterior button 122. In this example, button 122 protrudes outward from front surface 123, where it may be manually engaged by a user, for example. To rotate armature 116, thereby either releasing or locking tool 100 within a corresponding tool holder, button 122 may be pushed. Pushing button 122 causes rack 114 to move laterally, thus causing pinion 110 and upper gear member 108 to rotate. Disc magnets 106 secured to gear member 106 may then be rotated, causing a shift in magnetic alignment within tool 100.

Figure 7B:
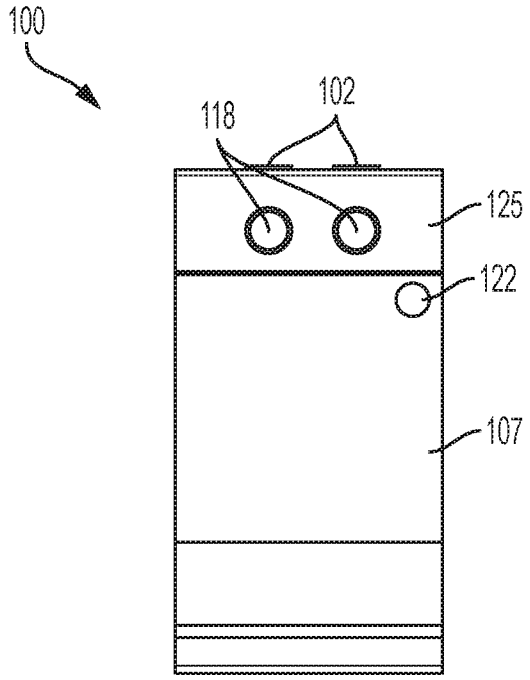
FIG. 7B is a front view of the tool.

FIG. 7B is a front view of tool 100. As shown in FIG. 7B, each first magnet 102 may protrude above the plane defined by top surface 115. Button 122 is positioned beneath tang 125, within body 107 of tool 100.

Figure 7C:
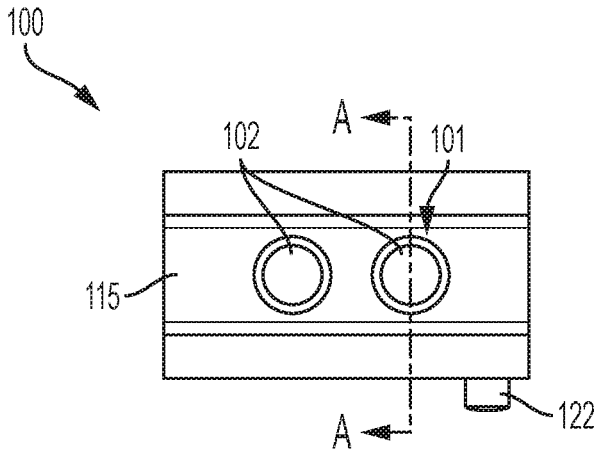
FIG. 7C is a top view of the tool.
Figure 7D:
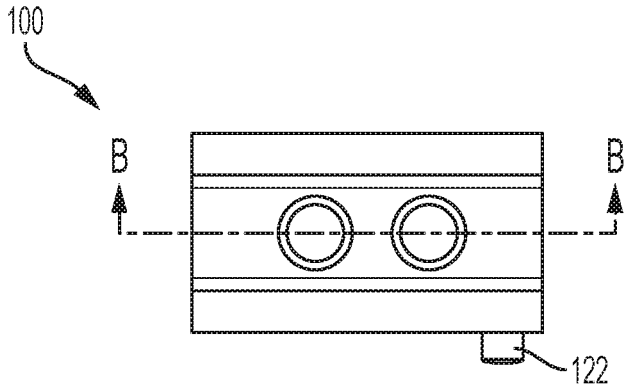
FIG. 7D is an alternate top view of the tool.

FIG. 7C is a top view of tool 100. FIG. 7D is an alternate top view of tool 100, showing section B-B.

As shown in FIGS. 7B and 7C, a first set of magnets 102 may be exposed at top surface 115. This particular embodiment includes two vertical magnetic assemblies 101. In other examples, the number, size, and/or arrangement of magnetic assemblies 101 may vary. Button 122 is shown protruding laterally outward from tool 100. FIG. 7C also shows line A-A, which denotes a cross-sectional plane used for illustration purposes.

Figure 7E:
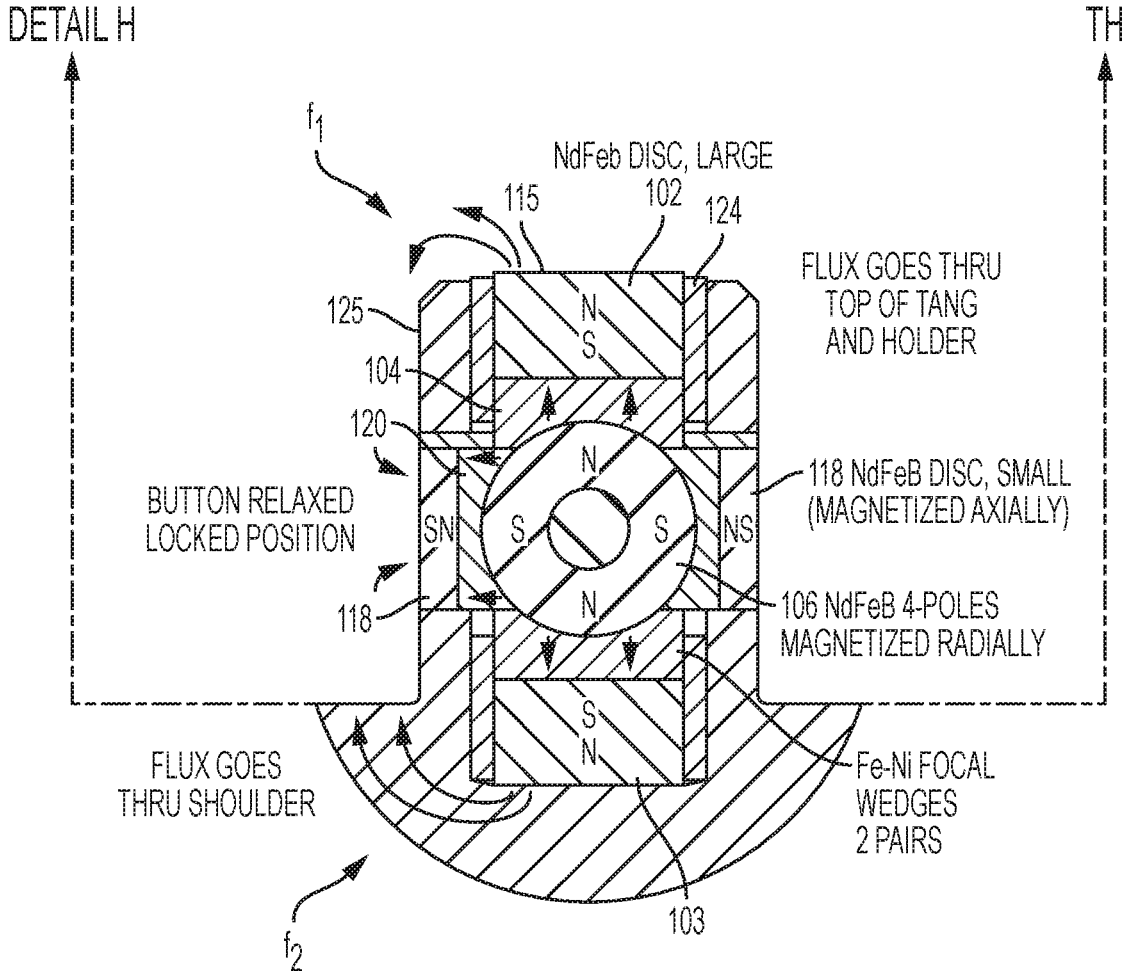
FIG. 7E is a section view of the tool at detail H, taken along line A-A of FIG. 7C, showing magnetic flux paths.

FIG. 7E is a section view of detail H, taken along section A-A of FIG. 7C. With button 122 in a relaxed position, tool assembly 100 is in a locked or engaged configuration with respect to the tool holder. In the locked position, tool assembly 100 may form two magnetic circuits comprised of separate pathways of magnetic flux: flux pathway $f_1$ and flux pathway $f_2$. As shown in FIG. 7E, flux pathway $f_1$ is guided in a counterclockwise direction through disc magnet 106 to first magnet 102, through top surface 115 of tang 125 into a ferromagnetic portion of a tool holder TH, and back through one of side magnets 118. The alternating magnetic poles of disc magnet 106, top magnet 102, and side magnet 118 in this configuration may generate the closed magnetic circuit defined by flux pathway $f_2$.

Similarly, flux pathway $f_2$ is generated by the alternating magnetic poles of disc magnet 106, side magnets 118, and second magnet 103. As shown in the figure, flux pathway $f_2$ may be guided in a clockwise direction, passing from disc magnet 106 to second magnet 103, through a ferromagnetic shoulder portion of a tool holder TH, and back through side magnet 118.

In combination, flux pathways $f_1$ and $f_2$ may generate a strong upward force to at least temporarily secure tool 100 within a corresponding tool holder. By generating two circuits that work in cooperation, tool 100 may drive a magnetic flux through a larger portion of tool holder TH relative to other tool and punch designs.

As further shown in FIG. 7E, first magnet 102 may be an NdFeB disc, which may also be large, while side magnets 118 may be smaller, axially magnetized NdFeB discs. Disc magnet 106 may also be an NdFeB magnet. Disc magnet 106, however, may be magnetized radially. Focal wedges 104 and lateral focal wedges 120 may each be made of iron-nickel compositions in one example.

Figure 7F:
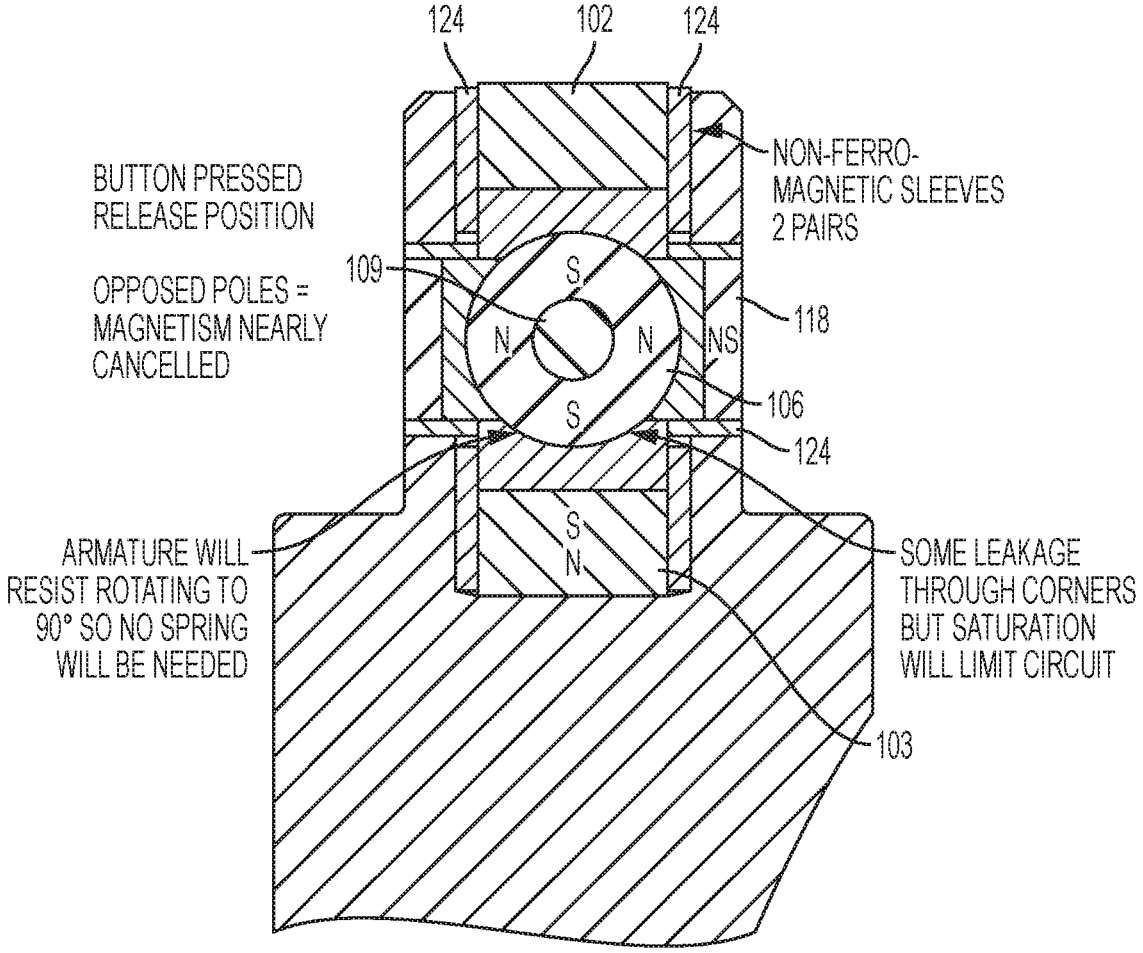
FIG. 7F is an alternate section view of the tool.

FIG. 7F is a section view of tool 100, taken along section A-A of FIG. 7C. FIG. 7F shows tool 100 in a release position caused by pressing button 122. As shown in FIG. 7F, pressing button 122 causes disc magnet 106 to rotate. In some examples, disc magnet 106 will rotate up to about 90°. Armature 116 may resist the rotation of disc magnet 106 beyond 90° such that no internal bias member, e.g., spring, may be necessary. In some examples, a bias member may be included to prevent over-rotation of armature 116. Rotation of disc magnet 106 causes the magnetic poles between disc magnet 106, first magnet 102, second magnet 103, and each side magnet 118 to misalign, thereby nearly cancelling magnetic circuits x and y. Without a magnetic flux through tool 100 and a tool holder, the force urging tool 100 upward into a tool holder may be diminished, allowing removal of tool 100 from the tool holder.

As further shown in FIG. 7F, non-ferromagnetic sleeves 124 may house magnetic assemblies 101 and side magnets 118 within tool 100.

Figure 7G:
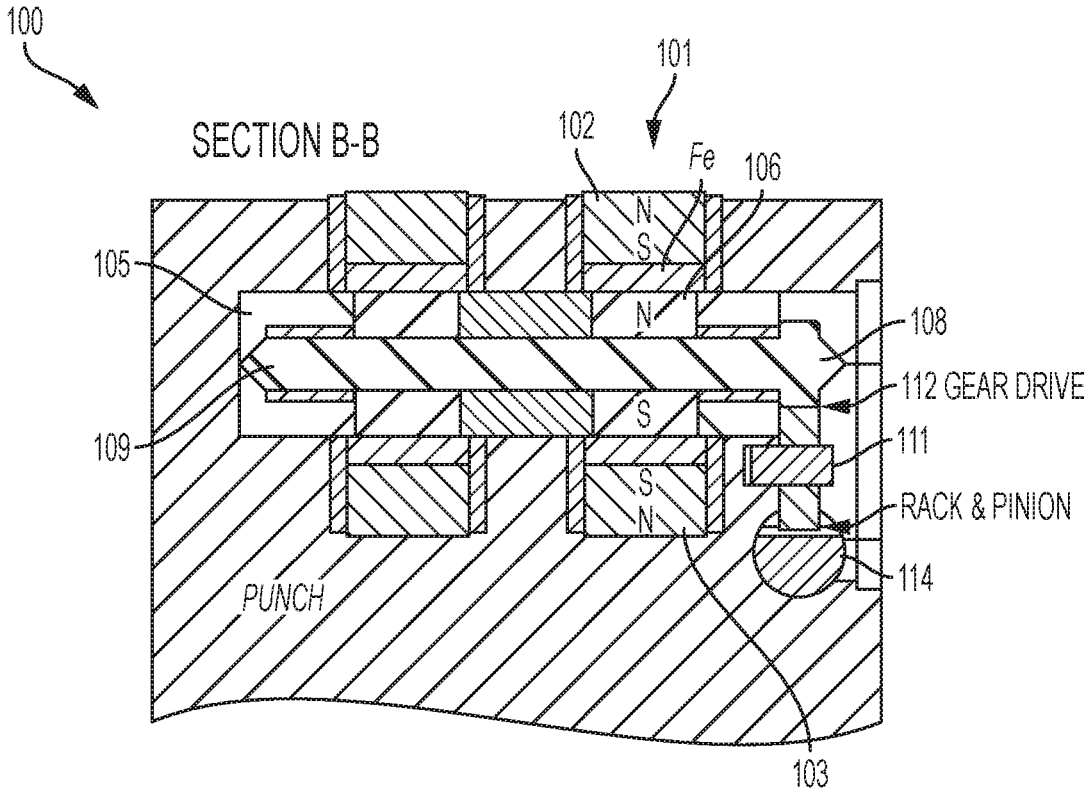
FIG. 7G is a further section view of the tool, taken along line B-B of FIG. 7D.

FIG. 7G is a section view of tool 100 taken along line B-B of FIG. 7D. In this example, body 109 may extend the entire length of lateral cavity 105.

Figure 8A:
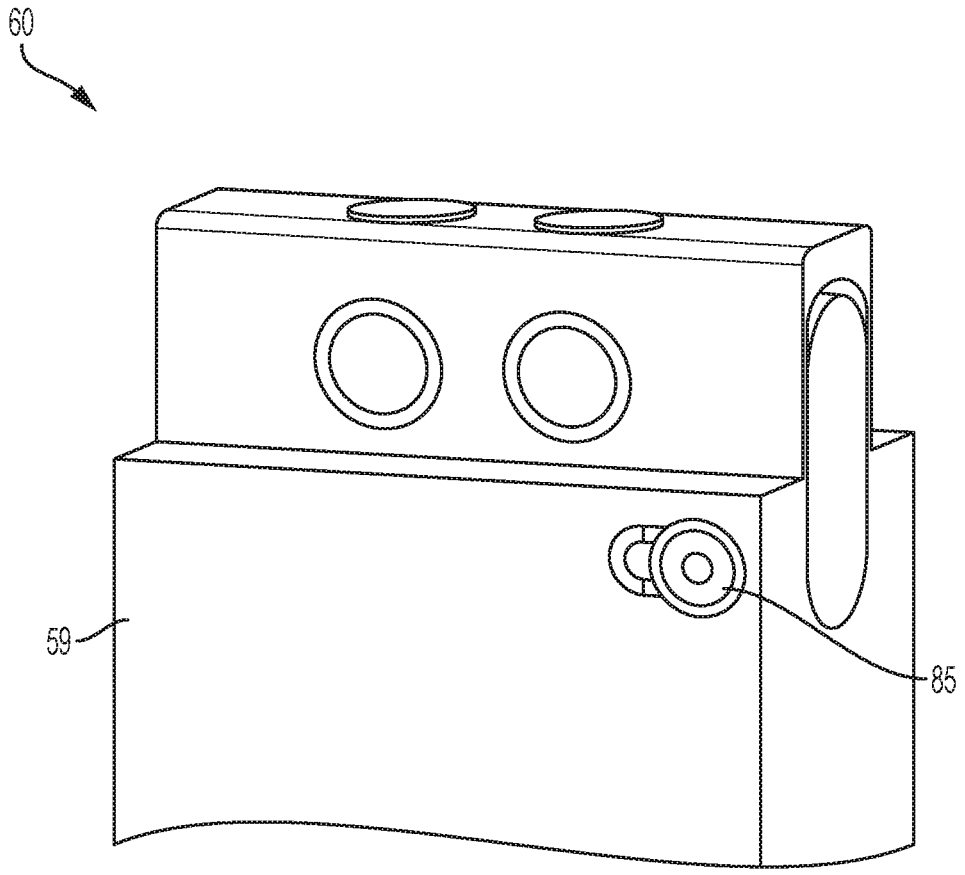
FIG. 8A is an isometric view of the tool, with an external handle mechanism.

FIG. 8A is an isometric view of tool 60 for a press brake or similar machine apparatus. As shown in FIG. 8A, tool 60 includes an external handle mechanism 85. In this particular embodiment, handle mechanism 85 includes a slidable handle component that protrudes from front surface 59 of tool 60. Handle mechanism 85 may be shaped to be graspable by a user. By moving handle mechanism 85 laterally, armature 68 may be moved laterally within tool 60. Thus, handle mechanism 85 may be engaged to alternate tool 60 from a locked to an unlocked configuration.

Figure 8B:
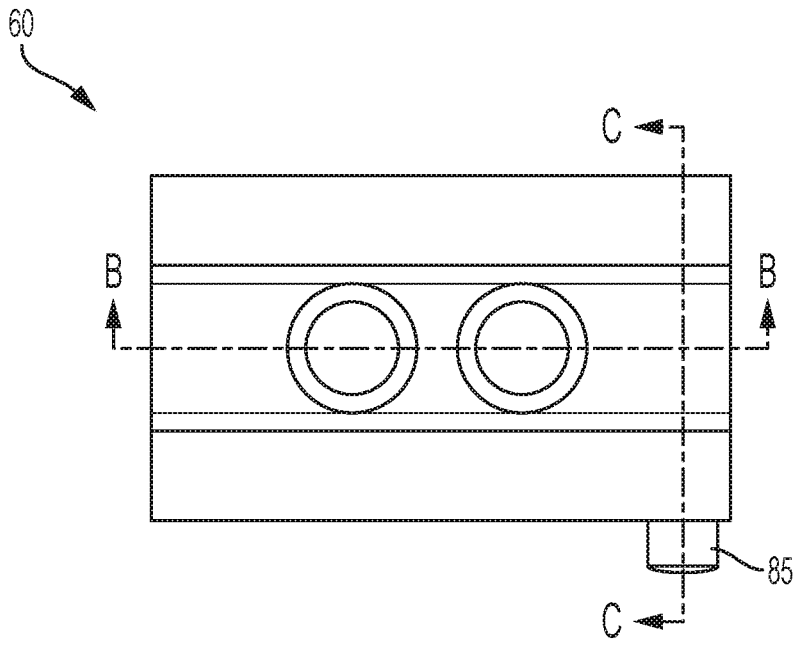
FIG. 8B is a top view of the tool showing the handle mechanism.

FIG. 8B is a top view of tool 60. As shown in FIG. 8B, handle mechanism 85 protrudes laterally outward from tool 60 for user access.

Figure 8C:
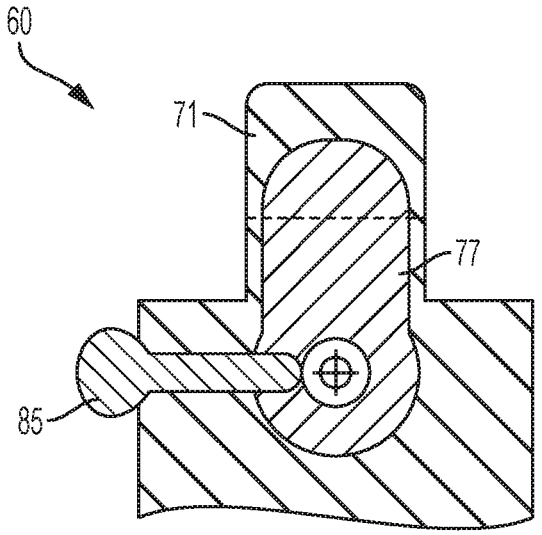
FIG. 8C is a section view of the handle mechanism, taken along line C-C of FIG. 8B.

FIG. 8C is a section view of handle mechanism 85, taken along line C-C of FIG. 8B. Handle mechanism 85 may be coupled, attached, or otherwise secured to armature 68 via transverse member 77. In some examples, handle mechanism 85 may be directly or indirectly coupled to armature 68. For instance, handle mechanism 85 may be inserted into an aperture or cavity defined by transverse member 77. As depicted in FIG. 12C, handle mechanism 85 may be secured to the outer surface of transverse member 77. In other embodiments, handle mechanism 85 may be integrally formed with transverse member 77.

Figure 8D:
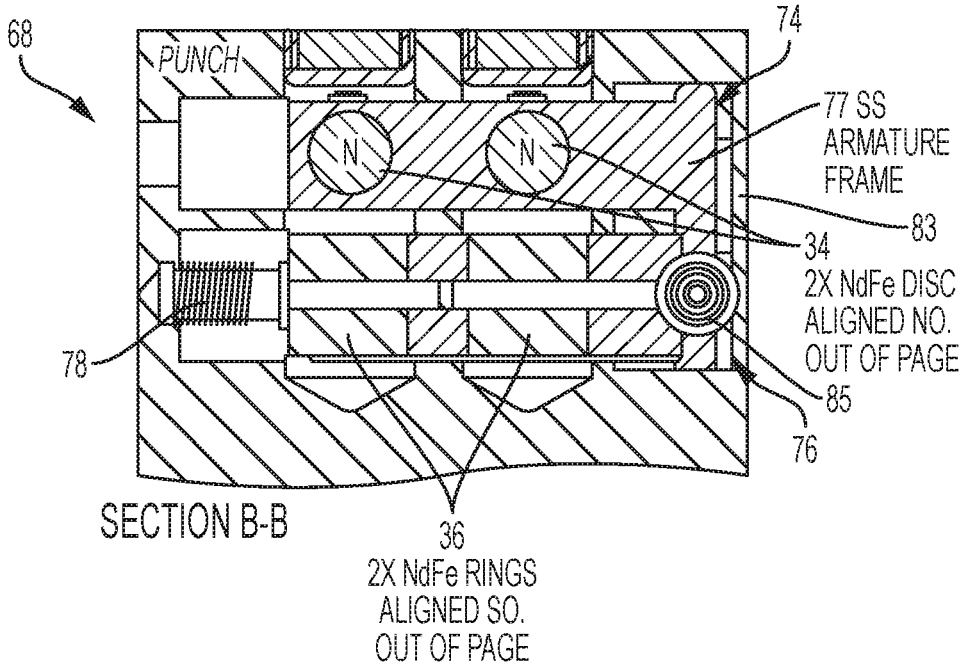
FIG. 8D is a section view of the tool in an engaged position, taken along line B-B of FIG. 8B.

FIG. 8D is a section view of tool 60, taken along line B-B of FIG. 8B. FIG. 8D illustrates tool 60 in a latched, engaged or "locked" configuration in which handle mechanism 85 is not urged laterally in a direction against the lateral force exerted by bias member 78. Thus, bias member 78 remains uncompressed, and the polarity of the magnets 34, 36 within armature 68 remain aligned with side magnets 64.

In this example, handle mechanism 85 may be coupled with transverse member 77 of armature 68. With handle 85 protruding laterally outward with from front surface 59, armature 68 may not need to be directly engaged by a user. Thus, in this particular embodiment, tool 60 may lack external openings exposing transverse member 77. As shown in FIG. 8D, end wall 83 may provide a barrier to the exposure of transverse member 77.

Figure 8E:
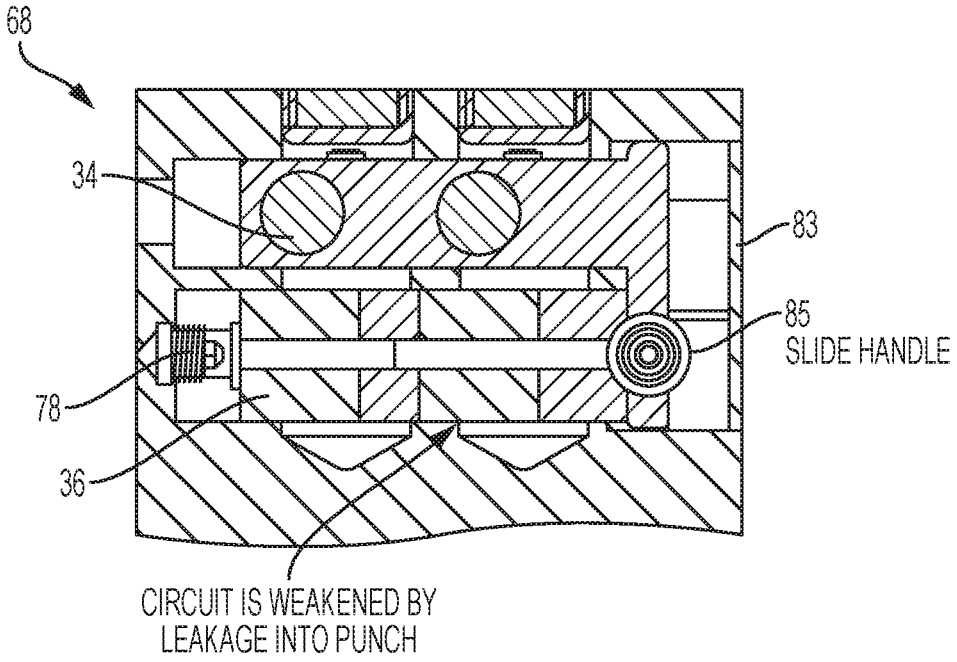
FIG. 8E is an alternate section view of the tool in a released position.

FIG. 8E is a section view of tool 60 taken along line B-B of FIG. 8B. FIG. 8E shows tool 60 in a release, or unlocked, configuration in which handle 85 has been slid or otherwise urged to the left and bias member 78 is at least partially compressed, causing the magnets 34, 36 to misalign with side magnets 64, thus weakening the magnetic flux coupling between tool 60 and its corresponding tool holder. As shown in FIG. 8E, movement of armature 68 directly corresponds to movement of handle 85.

Figure 9A:
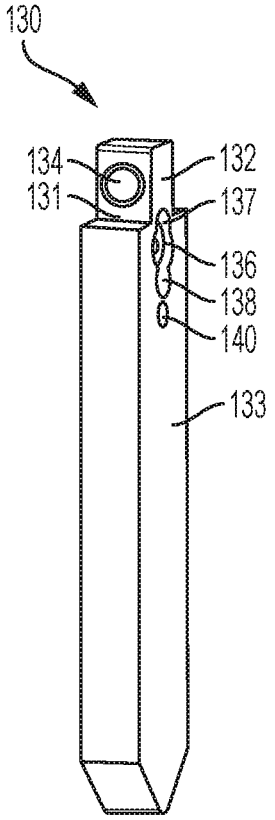
FIG. 9A is an isometric view of a tool for a press brake apparatus, in a narrow profile configuration.

FIG. 9A is an isometric view of tool 130 for a press brake or similar machine apparatus. Tool 130 may be smaller in profile relative to other tool configuration. Thus, tool 130 may only require two magnets to create a magnetic flux sufficient to at least temporarily hold tool 130 within a corresponding tool holder. As shown in FIG. 9A, tool 130 may include a top magnet 134 within tang 132. A bottom magnet 136 may be positioned beneath tang 132, laterally exposed at surface 133. Tool 130 may further include one or more air gaps positioned to divert a magnetic flux toward the shoulders of a tool holder. In this particular configuration, tool 130 includes a first air gap 137, a second air gap 138, and a third air gap 139, each defined by openings in surface 133.

Figure 9B:
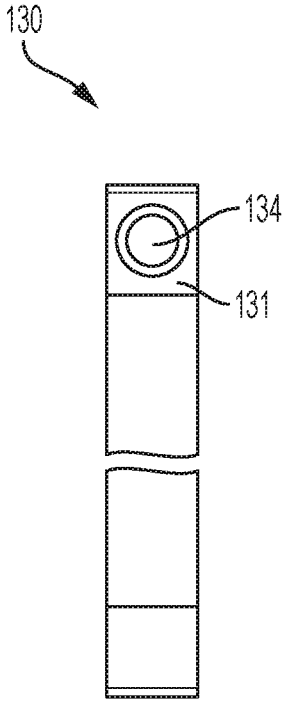
FIG. 9B is a front view of the tool in FIG. 9A.

FIG. 9B is a front view of tool 130. As shown in FIG. 9B, one or more top magnet components 134 may be exposed at reference face 131 of tool 130.

Figure 9C:
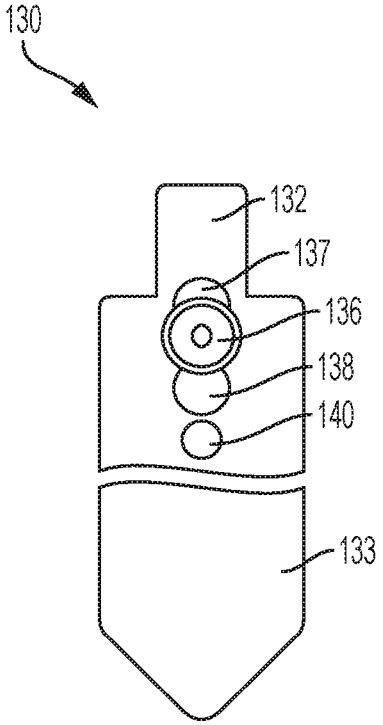
FIG. 9C is a side view of the tool.

FIG. 9C is a side view of tool 130, showing surface 133. Air gaps 137, 138, and 140 may be arranged in vertical fashion. The air gaps illustrated in FIG. 9C are each circular or semicircular. In some examples, the size and/or shape of each air gap may vary. FIG. 9C also shows bottom magnet 136, exposed at surface 133 and overlapping with air gaps 137 and 138.

Figure 9D:
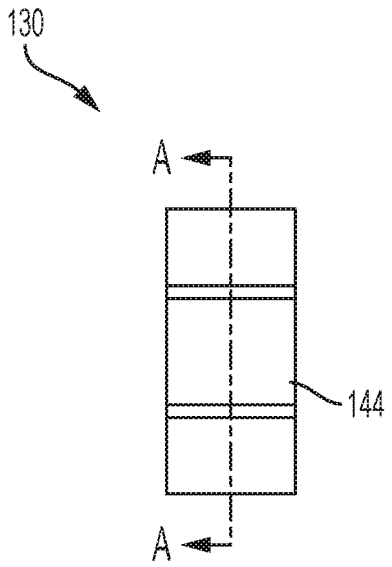
FIG. 9D is a top view of the tool.

FIG. 9D is a top view of tool 130. As shown in FIG. 9D, no magnetic assemblies or sub-assembly components may be visible on top surface 144.

Figure 9E:
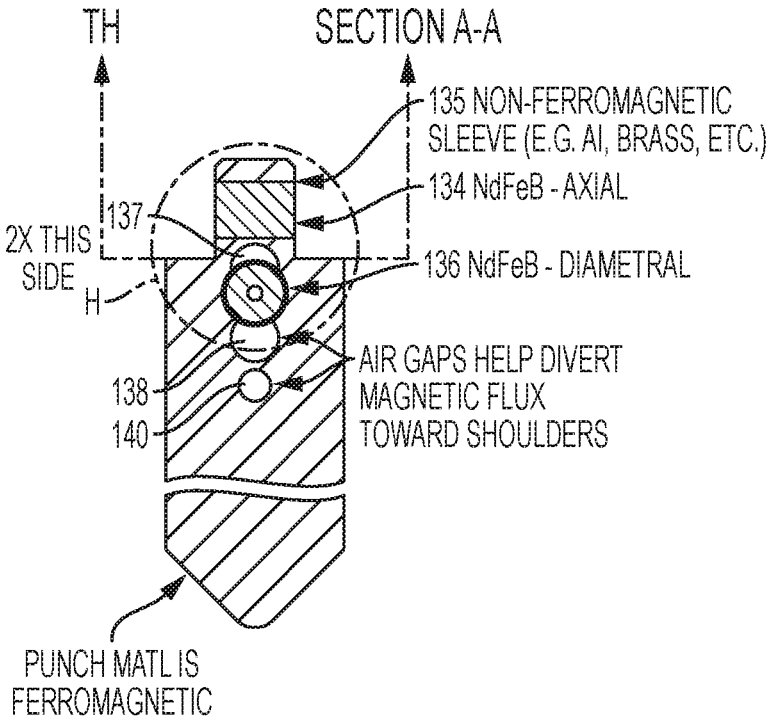
FIG. 9E is a section view of the tool, taken along line A-A of FIG. 9D.

FIG. 9E is a section view of tool 130, taken along line A-A of FIG. 9D. As shown in FIG. 9E, top magnet 134 may be housed within a non-ferromagnetic housing or sleeve 135. Sleeve 135 may be made from various materials, including but not limited to aluminum or brass. Each of top magnet 134 and bottom magnet 136 may be an NdFeB magnet. Top magnet 134 may be axially magnetized, while bottom magnet 136 may be diametrically magnetized. As further shown in FIG. 9E, each air gap 137, 138, 140 may comprise a lateral through-hole. Tool 130 may be inserted into tool holder TH.

Figure 9F:
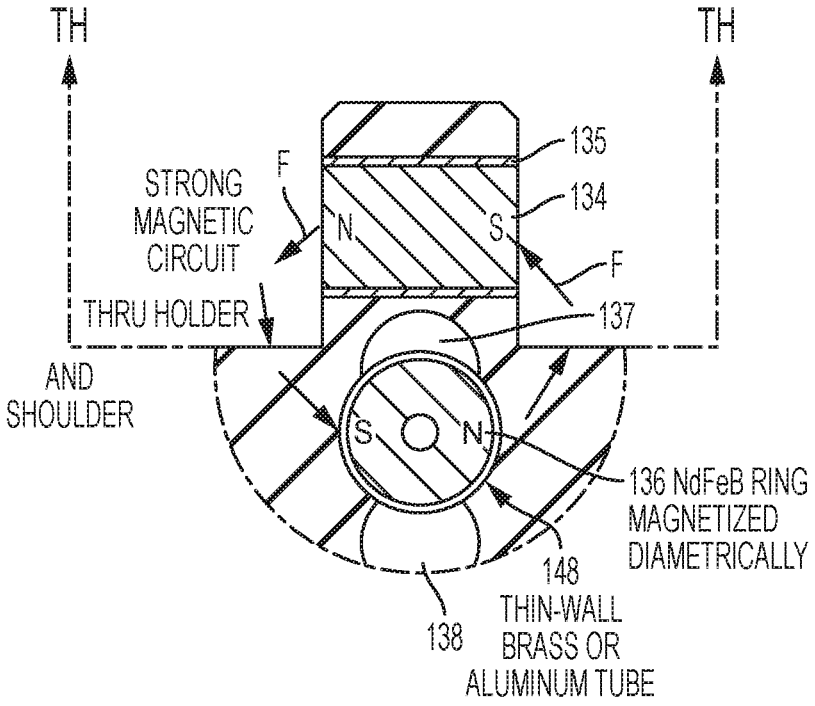
FIG. 9F is an alternate section view of the tool at detail H of FIG. 9E.

FIG. 9F is a section view of tool 130 at detail H, taken along line A-A of FIG. 10D. FIG. 9F shows magnetic flux F that may be generated by the arrangement of top magnet 134, bottom magnet 136, and the ferromagnetic components of tool holder TH. In particular, top magnet 134 may be axially magnetized and oriented such that its north pole is to the left of its south pole in the embodiment depicted. Bottom magnet 136 may be oriented such that its south pole is positioned to the left of its north pole. In this configuration, magnetic flux F may be guided through top magnet 134, a portion of tool holder TH, and down to bottom magnet 136. After passing through bottom magnet 136, the magnetic flux may be guided upward toward top magnet 134, after passing through another portion of tool holder TH.

In these examples, lower magnet 136 may be ring-shaped and circumferentially encompassed by tube 148. Tube 148 may be made from various materials, including but not limited to brass or aluminum.

Figure 10:
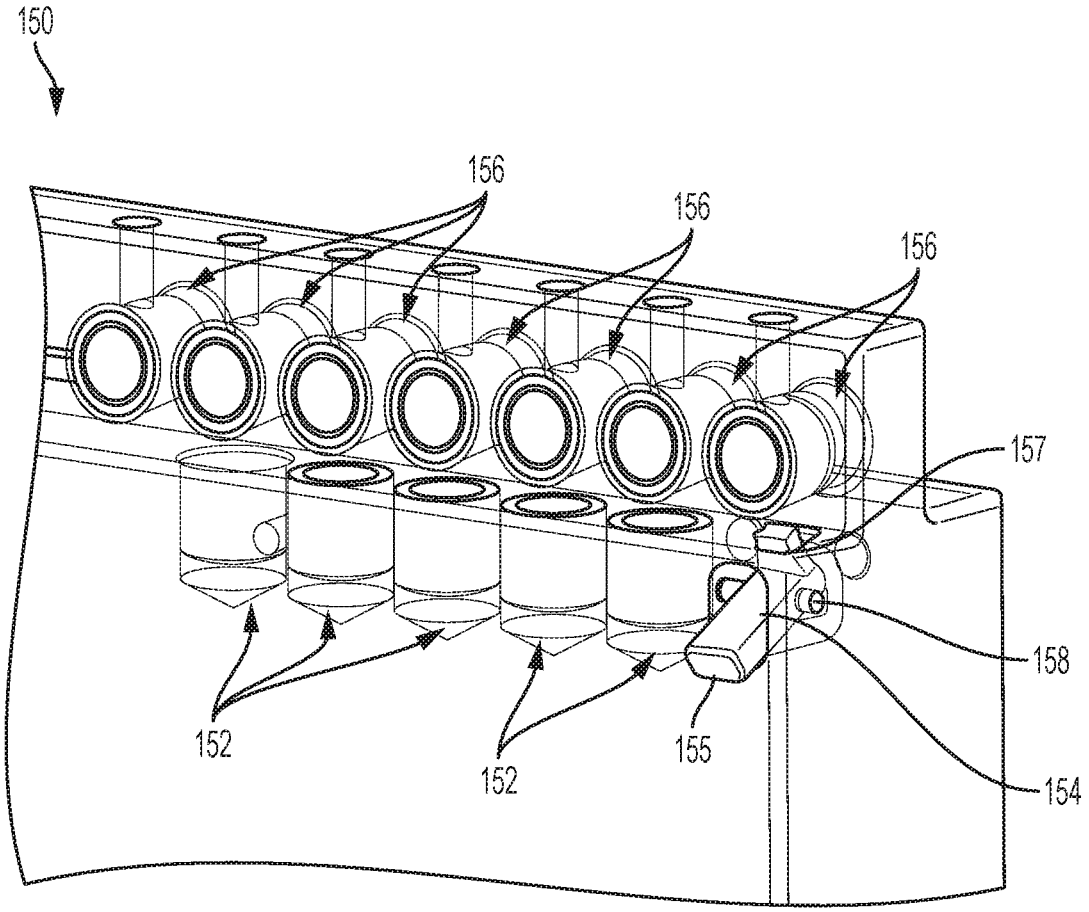
FIG. 10 is an isometric view of a tool for a press brake or similar machine apparatus, showing an alternate internal magnetic coupling structure and a decoupling member.

FIG. 10 is an isometric view of a tool 150 for a press brake or similar machine apparatus, showing internal structure. As shown in FIG. 10, tool 150 may contain a plurality of fixed magnet island assemblies 152 and a release lever 154. Tool 150 also includes a plurality of horizontal magnets 156 that collectively increase frictional holding of tool 150 within a corresponding tool holder. To facilitate removal of tool 150 from a tool holder, release lever 154 may be urged downward at distal end 155, thereby causing protrusion 157 to pivot about pin 158 and exert an outward force against an inner surface of the tool holder, effectively prying tool 150 away from the holder. Such prying may weaken the magnetic circuit generated by magnetic island assemblies 152 and the holder by urging the coupling end of the tool body 150 from the tool holder, creating an air gap in the magnetic flux path between the tool body 150 and the tool holder. Other decoupling members, in addition or alternatively to lever 154, may be implemented in various examples. Each decoupling member can be configured to mechanically urge tool 150 away from a tool holder by creating an air gap therebetween, thereby allowing removal of tool 150 from the holder.

The release or decoupling mechanism can include one or more pry bar or lever members 154 engaged with the tool or tool body 150. As shown in FIG. 10, each pry bar or lever member 154 extends from a first end 155 to a second end or protrusion 157, with the second end 157 configured to selectively disengage the coupling end of the tool body 150 from the tool holder upon actuation of the first end. The first end 155 of the pry bar or lever member 154 may be accessible by a user, e.g., with the coupling end of the tool body 150 engaged in the tool holder, with the second end 157 of the pry bar or lever member 154 configured to protrude from the tool body 150 to selectively disengage the coupling end from the tool holder upon manipulation of the first end 155 by the user. A biasing element can be configured to bias the second end 157 of the pry bar or lever member 154 in a position disposed within the tool body 150, absent manipulation of the first end 155, or when the first end 155 is released.

Figure 11A:
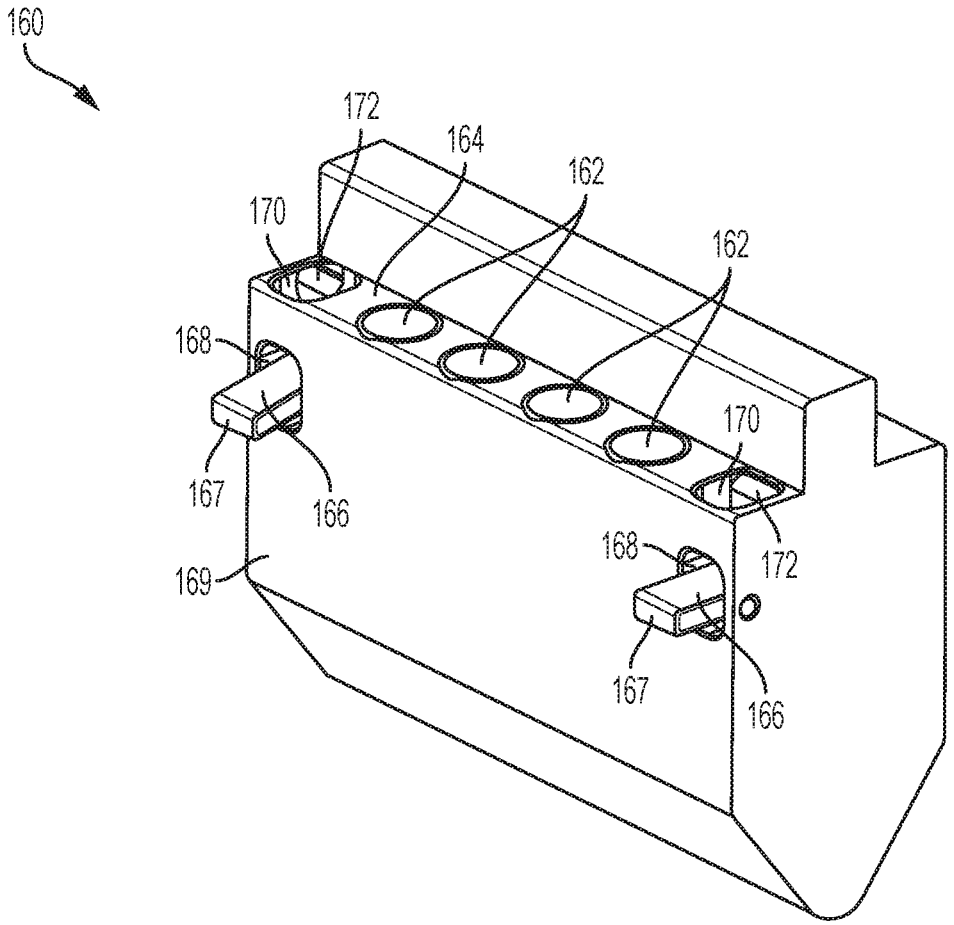
FIG. 11A is an isometric view of a tool for a press brake or similar machine apparatus, showing two decoupling members.

FIG. 11A is an isometric view of a tool 160 for a press brake or similar machine apparatus. Tool 160 includes a plurality of fixed magnetic island assemblies 162 disposed within a load-bearing shoulder 164 of the tool. Two levers 166 protrude from their respective access windows 168 at a front surface 169 of the tool. Each lever 166 defines an actuating end 167 and a decoupling end 172. Shoulder 164 defines two decoupling windows 170, through which the decoupling end 172 of each lever 166 protrudes various distances depending on the position of each lever 166.

In operation, magnetic island assemblies 162 can be configured to induce a magnetic flux coupling with a tool holder. Each magnetic island assembly 162 may include one or more permanent magnets, ferromagnetic components, and/or non-ferromagnetic components configured to induce a magnetic flux coupling with a tool holder. The magnetic elements comprising each magnetic island assembly can be non-adjustable, such that the strength of the magnetic flux coupling depends only on the proximity of the upper portion of the tool 160 with a tool holder.

To disrupt the magnetic flux coupling and remove tool 160 from its tool holder, a user can manipulate one or both levers 166. Moving lever 166 downward, for example, causes the decoupling end 172 of the lever to move upward through decoupling window 170. Because the surface of shoulder 164 can be pressed flat against a receiving shoulder of a tool holder when the two components are coupled, upward motion of a decoupling end 172 through decoupling window 170 mechanically urges tool 160 away from the tool holder by creating an air gap therebetween. As the size of the air gap increases, the strength of the magnetic flux coupling decreases, such that tool 160 may be removed from the tool holder, either by gravity or user-assisted removal.

Figure 11B:
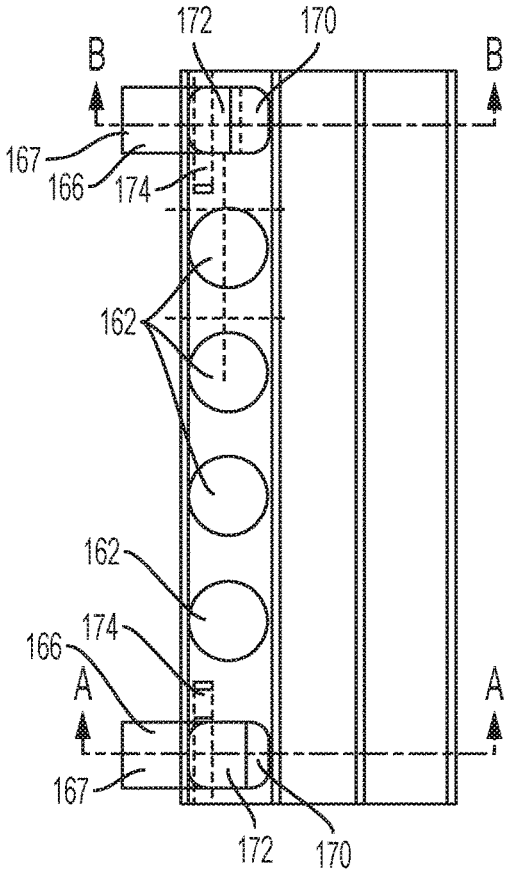
FIG. 11B is a top transparent view of the tool of FIG. 11A.

FIG. 11B is a top transparent view of tool 160. As shown, each lever 166 can rotate about a rotational axis defined by a pin 174. The pins 174 extend into the body of tool 160, anchoring the levers 166 to the body of the tool. In the embodiment shown, the coupling components, e.g., magnetic island assemblies 162, and decoupling components, e.g., decoupling ends 172, are each exposed at the surface of shoulder 164, thus positioned to engage with the same mating surface of a tool holder.

Figure 11C:
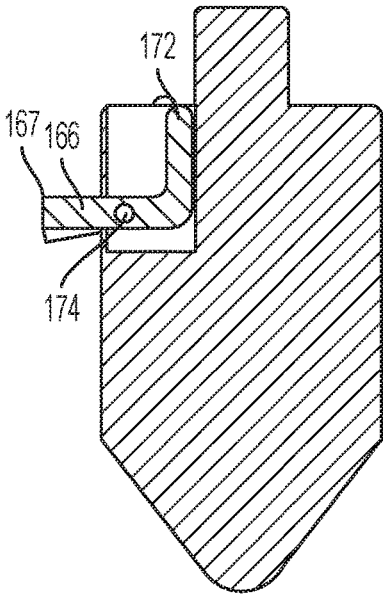
FIG. 11C is a section view of the tool, taken along line A-A of FIG. 11B.

FIG. 11C is a cross-sectional view of tool 160, taken along section A-A of FIG. 11B. As shown, lever 166 may be approximately L-shaped, with decoupling end 172 oriented approximately perpendicular to the actuating end 167. Lever 166 is shown in a resting or coupling configuration, in which the actuating end 167 is perpendicular to the front surface 169 of the tool and decoupling end 172 does not protrude from the surface of shoulder 174 through decoupling window 170.

Figure 11D:
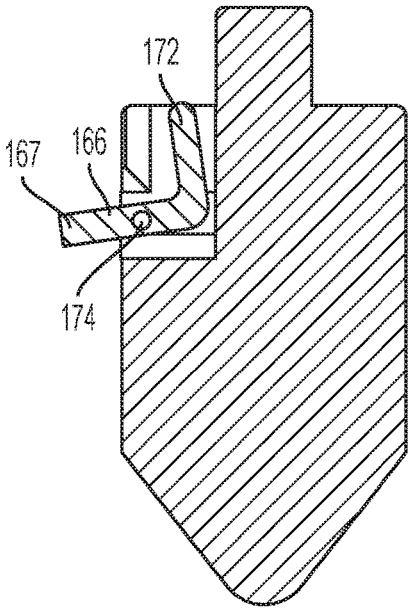
FIG. 11D is another section view of the tool, taken along line B-B of FIG. 11B.

FIG. 11D is a cross-sectional view of tool 160, taken along section B-B of FIG. 11B. Lever 166 is shown in a disengaged or decoupling configuration, in which actuating end 167 of lever 166 has been pushed downward, thus forcing decoupling end 172 upward through decoupling window 170. In this configuration, tool 160 may be mechanically urged from its tool holder. In some examples, each lever 166 must be in the decoupling configuration to effect release of tool 160 from the holder. In other examples, movement of one lever 166 to the decoupling configuration can suffice to urge tool 160 away from its tool holder.

Figure 12A:
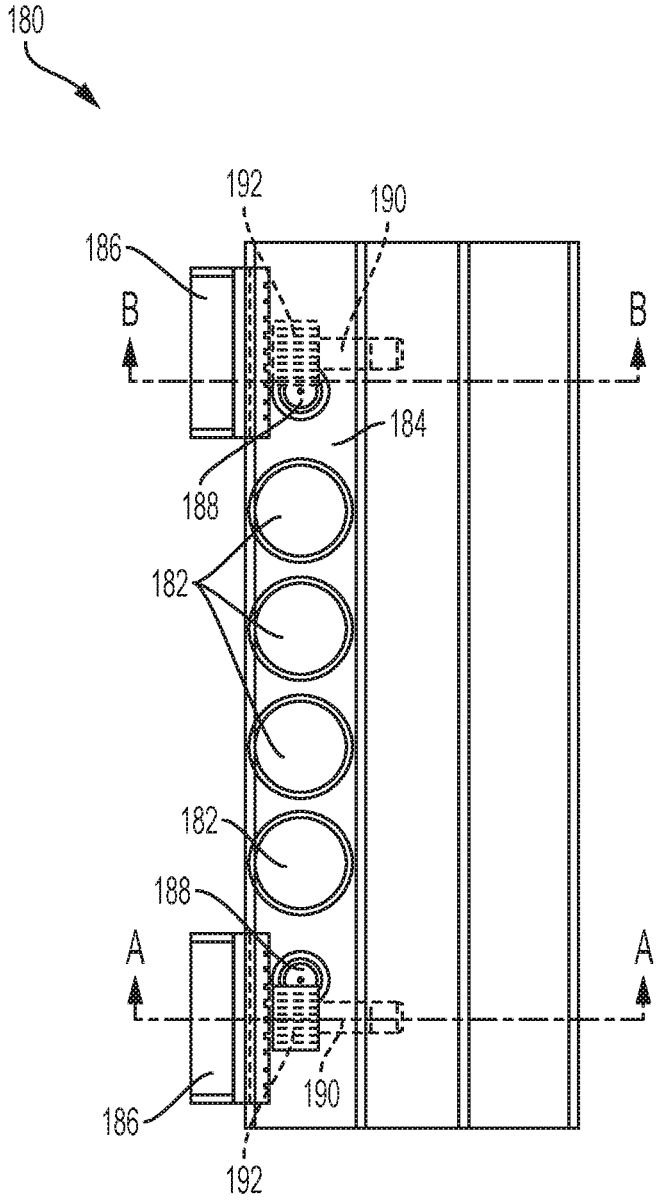
FIG. 12A is a top transparent view of a tool for a press brake or similar machine apparatus, showing alternate decoupling mechanisms.

FIG. 12A is a top transparent view of a tool 180 for a press brake or similar machine apparatus. Like tool 160, tool 180 includes a plurality of fixed magnetic island assemblies 182 exposed at a surface of a load-bearing shoulder 184 of the tool. Tool 180 also includes two decoupling actuators 186. Each decoupling actuator 186 is coupled to a pushbutton or slidable shaft or pin member 188, which when moved to a decoupling position, mechanically urges a tool holder away from tool 180.

Movement of the shaft or pin member 188 can be effected by movement of multiple movable components operationally coupled with each decoupling actuator 186. In operation, rotation of decoupling actuator 186 is translated into rotation of an inner portion 190 of the decoupling actuator that protrudes within the body of the tool. Rotation of each inner portion 190 causes rotation of internal gear member 192. Internal gear member 192 rotatably engages the shaft or pin 188 via a plurality of complementary grooves defined by the gear member and the pushbutton.

Figure 12B:
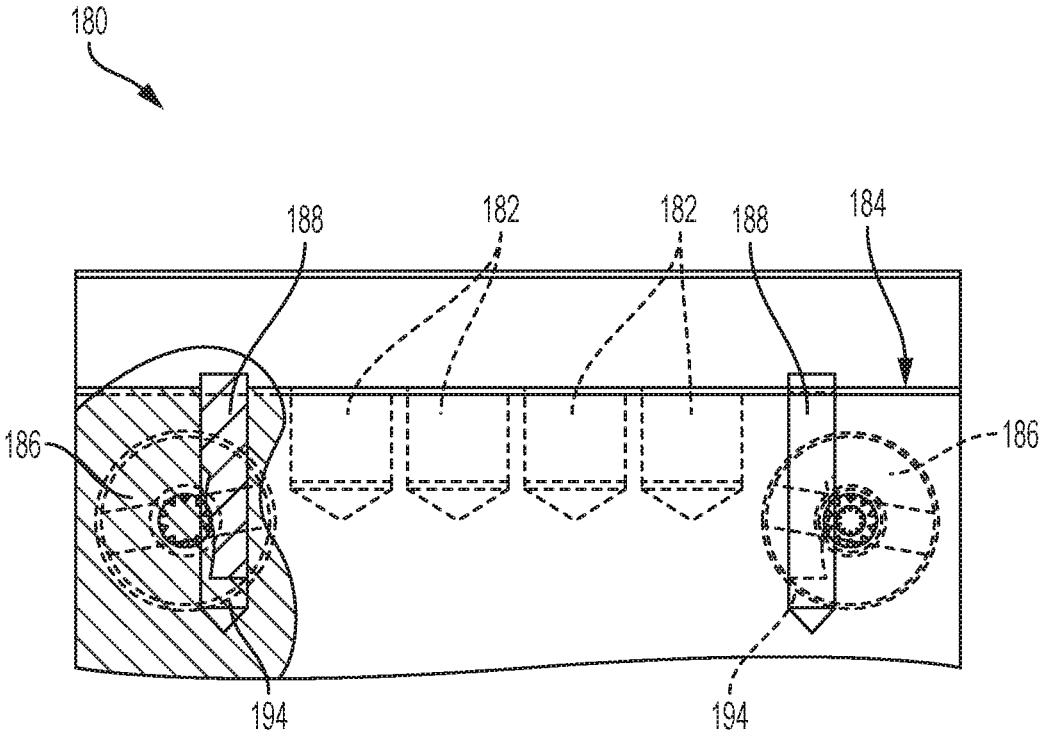
FIG. 12B is a front transparent view of the tool of FIG. 12A, showing the internal components of the decoupling mechanisms.
Figure 12C:
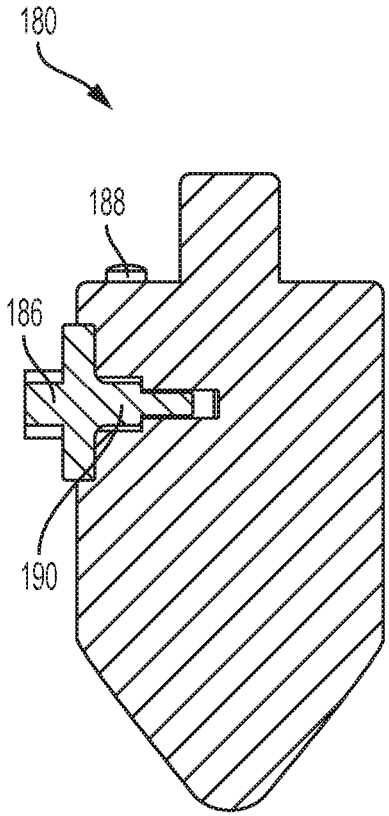
FIG. 12C is a section view of the tool, taken along line A-A of FIG. 12A.

FIG. 12B is a front transparent view of tool 180, showing magnetic island assemblies 182, each pin or shaft member 188, and each decoupling actuator 186. In the decoupling configuration shown, each member 188 protrudes above the top surface of shoulder 184, thereby mechanically urging tool 180 away from its corresponding tool holder. As further shown, each member 188 moves bi-directionally within a pushbutton cavity 194, a portion of which is vacant upon displacement of the pushbutton above the top surface of the shoulder. The distance by which each member 188 protrudes from shoulder 184 may vary, and may depend at least in part on the strength of the magnetic flux coupling induced by tool 180 and a corresponding tool holder. For example, a stronger magnetic flux coupling may necessitate greater extension of each shaft or pin member 188 to mechanically urge tool 180 away from its tool holder, forming an air gap in the magnetic flux coupling.

Each decoupling actuator 186 may be manipulated by a user. In the specific embodiment shown, each decoupling actuator 186 comprises a rotatable knob. Alternative configurations of the decoupling actuators 186, e.g., pushbuttons, levers, pins, switches, etc., are also within the scope of this disclosure.

FIG. 12C is a section view of tool 180, taken along section A-A of FIG. 12A. As shown, a portion of decoupling actuator 186 may protrude from tool 180 for user engagement, while inner portion 190 may extend a distance within the body of the tool. In some examples, inner portion 190 may anchor decoupling actuator 186 to tool 180.

Figure 12D:
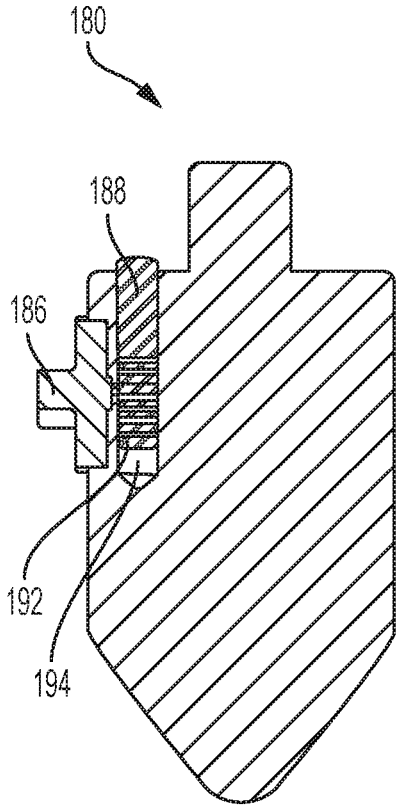
FIG. 12D is another section view of the tool, taken along line B-B of FIG. 12A.

FIG. 12D is a section view of tool 180, taken along section B-B of FIG. 12A. Gear member 192 is shown, along with pushbutton cavity 194. By engaging with complementary grooves defined by the shaft or pin member 188, rotation of gear member 192 causes linear movement of member 188. In this manner, rotation of decoupling actuator 186 causes linear movement of member 188, which can release tool 180 from the tool holder.

Suitable release mechanisms include a longitudinal shaft or pin member 188 engaged with the tool body 180, the longitudinal shaft or pin member 188 extending from a first (e.g., bottom) end configured for actuation by a user to a second (e.g., top) end configured to selectively disengage the coupling end of the tool body 180 from the tool holder upon actuation of the first end. The longitudinal shaft or pin member 188 can be disposed in sliding engagement within the tool body 180, e.g., with the second end configured to extend from the tool body 180 to selectively disengage the coupling end from the tool holder upon actuation of the first end.

Figure 13:
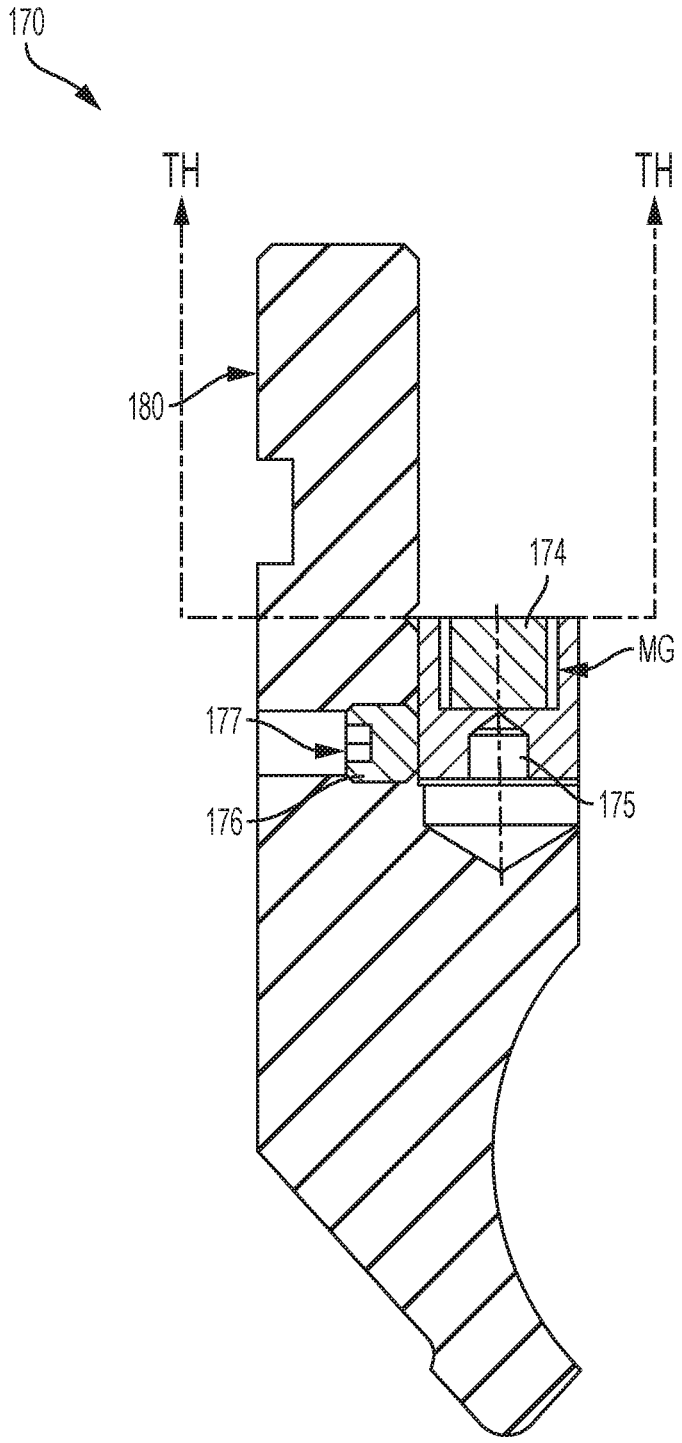
FIG. 13 is a section view of a tool for a press brake or similar machine apparatus.

FIG. 13 is a section view of tool 170 for a press brake or similar machine apparatus. As shown in FIG. 13, tool 170 includes a magnetic coupling assembly MG with two isolated "island" magnetic assemblies configured for holding tool 170 within a tool holder TH (dashed lines), e.g., where tool holder TH utilizes a side-clamping mechanism.

Tool 170 includes first magnetic assembly 174 and second magnetic assembly 176 that together form a magnetic circuit or circuits through tang 180 of tool 170 and the adjacent portion of tool holder TH, sufficient to at least temporarily secure tool 170 to tool holder TH. As further shown in the figure, first magnetic assembly 174 may be secured to tool 170 via first fastener 175. Similarly, second magnetic assembly 176 may be secured to tool 170 via second faster 177.

Figure 14:
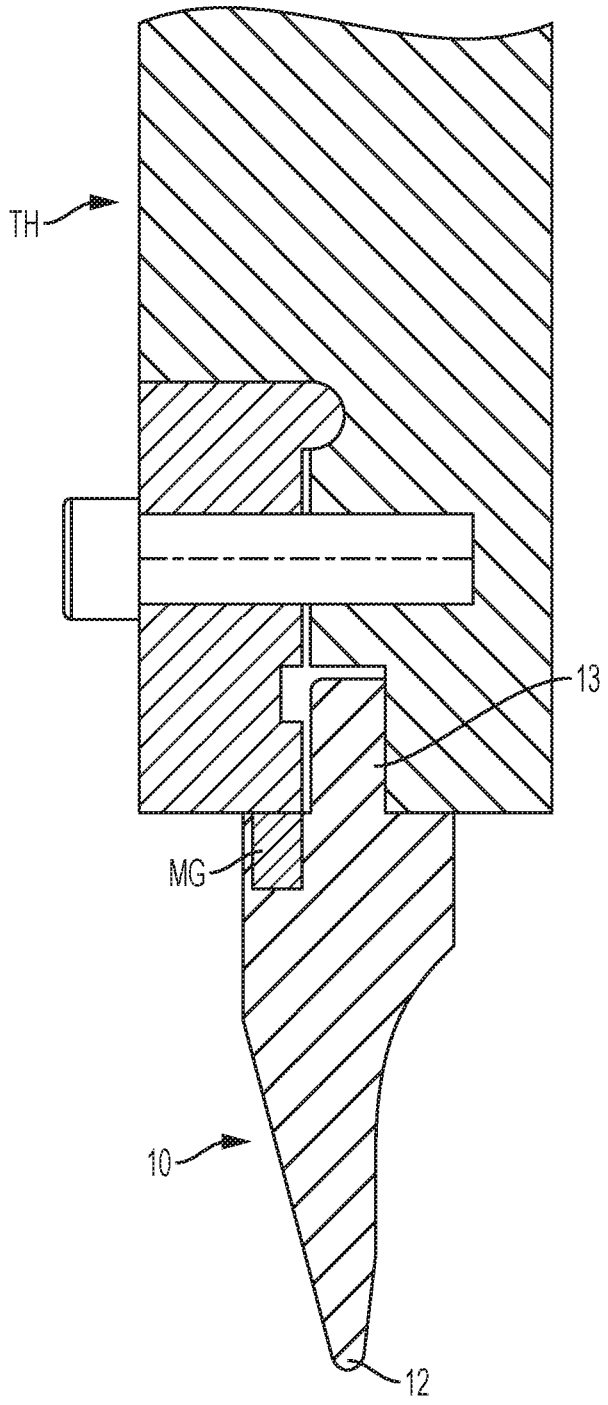
FIG. 14 is a section view of a press brake punch or tool coupled with a tool holder.

FIG. 14 is a section view of a press brake punch or tool 10 (or similar machine tool component 10, 60, 100, 130, 150, 160, 170), with a magnetic coupling mechanism MG disposed in tang end 13, opposite working end 12 of tool 10. Coupling mechanism MG is configured for selective engagement of tool 10 within tool holder TH, as described herein.

Suitable examples of tool holder TH are described, for example, in U.S. Publication No. 2007/0144232 to Shimota et al., which is incorporated by reference, in the entirety and for all purposes. In any of the embodiments described herein, tool holder TH may comprise a preexisting tool holder lacking defined stationary or movable magnetic elements. As described herein, at least a portion of tool holder TH may comprise a ferromagnetic material. Tool 10 may additionally be secured by a bolt BO or similar mechanical fixture, as known in the art.

Applications

As described above, a safety latch mechanism is applied to Folding Press or Press Brake Tooling to hold the Punch up until it is clamped in place.

Press Brake punches with a safety latch which can selectively hold the punch up into the holder until the holder clamping is activated, are useful for installing large punches or multiple punches. There are various mechanisms for facilitating a releasable safety latch, one of which is a straight-in pushbutton and latch-pawl. There are additional latching mechanisms not described in the prior art; this document describes such mechanisms.

Suitable applications of the present safety mechanism include, but are not limited to, improved safety mechanism for tooling machinery described in U.S. Pat. Nos. 5,245,854, 6,467,327; 6,732,564; 6,928,852; 7,004,008; 7,021,116; 7,661,288; 7,810,369, each of which is incorporated by reference herein, in the entirety and for all purposes.

More specifically, a magnetic safety latch mechanism is applied to a folding press or press brake punch, for example where a protrusion at the top of the punch fits into a receiving, downward-facing cavity in the punch holder. Such systems may have an actuating mechanism in the upper tool holder or punch holder, which clamps all of the punches simultaneously, for securely holding said punches in place while folding or forming the work-piece, which is typically sheet metal. Such tool holder systems have the advantage of simplicity, but make it awkward to deploy multiple punches without some mechanism to hold some punches in place, temporarily, while others are being installed. Conventional safety tang designs, for their part, may require the punches to be installed in the correct order, and slid into the holder from one end. Other traditional safety latch mechanisms are known, such as laterally sliding or pivoting latches.

The present disclosure provides a magnetic assembly within the upper portion of each punch, to hold said punches safely in place, temporarily, so that the user's hands are free to install additional punches until the punch holder is activated to lock all of the punches in place for operation. Such magnetic assembly would ideally be comprised of an arrangement of strong (such as, but not limited to, NdFeB) permanent magnet assembly arranged within the punch such that the ferromagnetic properties of the punch itself are used to guide the magnetic flux in a circuit further involving the ferromagnetic or other material of the punch holder (e.g., typically medium-alloy steel), so that the punch will be urged upward by said magnetic flux so as to minimize non-ferromagnetic gaps (e.g., air) thus holding said punch up against the load-impinging shoulders of said punch holder.

It may be desirable that the magnetic circuit involves the shoulders of the punch holder: first to hold said punch firmly against said shoulders so that the punch is in an ideal position for clamping by the press, and secondly because the gap between the top of the punch tang and the inside of the holder is designed as clearance and is therefore not a precise or sufficiently small gap that it could be depended upon to form a reliable part of the magnetic circuit. Some embodiments can incorporate a movable part or movable parts of the magnetic circuit, e.g., permanent magnets or ferromagnetic components, which can be moved from one position with the magnetic circuit in a magnetically coupled or locked state, with a continuous flux path, and another position with the magnetic circuit in a magnetically decoupled or weakened (unlocked) state, e.g., by moving one or more components apart to create an air gap along the flux path, or by orienting a pair magnetic poles in opposition along the flux path.

Other variations of the magnetic assembly could use vertically aligned magnets or magnetic assemblies pressed into holes in the top of the tang, thus simplifying the machining needed to adapt stock punch material for receiving said assemblies, which assemblies would also protrude slightly from the top of the tang. A single or plural arrangement of press-fit, switchable magnetic assemblies could be deployed with an optimal protrusion from the punch tang to minimize the deficiency of the unknown gap at the tang top by using said resistively slidable magnetic assemblies which would thus adapt to the aforementioned gap variability. The magnetic assemblies could be made switchable by various mechanism including that of having part of the magnetic circuit involve a slidable permanent magnet with poles alternately in alignment, favorably, with the magnetic circuit, creating a latched position, or opposing so as to weaken or even cancel the magnetic attraction to the punch holder, creating the released position.

Similar magnetic work-piece clamping systems can also be used as part holders for such machines as surface grinders, as well as the use of a magnetic tool-holder for press-brake tooling as described here. Other variations could employ magnets or magnetic assemblies installed in the top of the punch shoulder of the tang.

Additionally, magnets or magnetic assemblies could be installed horizontally in the punch tang to hold or help hold the punch up with the friction created by the magnetic force between the punch tang vertical sides and the vertical walls inside the punch holder. Also encompassed is the application of a permanent magnet or magnets, in the punch or punch holder, without a switching mechanism or release state, which would be especially practical for smaller punches wherein the magnetic forces holding the punch in the holder could be easily overcome by hand.

EXAMPLES

Suitable examples and embodiments of the mechanisms and techniques described in this disclosure include, but are not limited to the following.

A punch for a folding press or press brake, with a top protrusion or tang that fits into a cavity in said press brake's upper tool holder, with a safety mechanism for temporarily holding said punch in said press brake using a switchable or adjustable permanent magnet assembly to urge or retain the punch upward into a holder receiving cavity for placement or staging until said holder is activated, thus clamping said punch solidly in place for use, the punch thus having a locked position where said punch is safely restrained in said punch holder, or an unlocked setting, where said punch can be manually installed in or removed from said punch holder.

The safety mechanism, where an assembly of permanent magnets and ferromagnetic parts are arranged to work cooperatively in a magnetic circuit, with some magnet(s) or part(s) made to be selectively moveable such that said magnetic circuit can be debilitated or weakened (as for punch installation or removal) or alternatively positioned so as to be optimized or enabled, to facilitate secure retention of punch in the holder until said holder is activated to clamp said punch solidly in the holder for folding operation.

The safety mechanism, where the magnetic assembly includes one or more electromagnets which could be switchable to selectively aid or conflict with the magnetic circuit, to effect retention or release of said punch. The safety mechanism, where the magnetic assemblies consist of two or more parallel circuits of combinations of magnets and ferromagnetic parts such that one switchable or adjustable assembly is thus scalable for higher magnetic forces to compensation. The safety mechanism, provided with a mechanism for directly leveraging or prying the punch away from the holder.

The safety mechanism, where one or more magnetic assemblies or permanent magnets are arranged along the length of a punch. The safety mechanism, where such magnetic assembly or assemblies employs a bi-stable or non-momentary locked and unlocked state. The safety mechanism, where the selectively moveable part or parts move slidably. The safety mechanism, where the selectively moveable part or parts move rotatably.

A safety mechanism for holding a punch in a folding press or press brake using a permanent magnet assembly or permanent magnet or array of magnets to urge or retain the punch upward into a holder receiving cavity for placement or staging until said holder is activated to grip said punch solidly in place for use, such non-adjustable magnetic assembly being practical for smaller punches, where the forces encountered would be low enough that said punches could be manually installed or removed to or from said holder without further mechanical adjustment or rearrangement of the magnetic circuit.

The safety mechanism, provided with a mechanism for directly leveraging or prying the punch away from the holder. The safety mechanism, where the magnets or magnetic assemblies are held in place with set-screws, glue, spring-pins, or such as are obvious variations of methods for securing said magnets or magnetic assemblies to the punch. The safety mechanism, where the magnet or magnets are installed in the punch shoulder or tang with additionally assembly features.

A safety mechanism for holding a punch in a Folding Press or Press Brake using a permanent magnet assembly to urge the punch upward into a holder receiving cavity for placement or staging until said holder clamps said punch solidly in place for use, with non-adjustable magnets but with a mechanism for debilitating the magnetic circuit via an increasing gap or gaps in said magnetic circuit by leveraging or prying apart some part(s) within said magnetic circuit.

The safety mechanism, with a selectable mechanism for dissipating magnetic flux away from the productive magnetic circuit by introducing a magnet or magnets or ferromagnetic part or parts to diverge some of the flux away from assisting in the punch-holding work of the magnetic circuit thus providing a selectably locked and unlocked state.

A press brake tool comprising: a tool body having a working end configured for operation on a workpiece and a coupling end configured for selective engagement with a tool holder, the working end disposed generally opposite the coupling end; a magnetic assembly comprising one or more magnetic elements configured to generate a magnetic flux coupling adapted for the selective engagement of the coupling end of the tool body with the tool holder; and a coupling mechanism configured to manipulate at least one of the magnetic elements to modulate a strength of the magnetic flux coupling, where the coupling mechanism is adapted for selective disengagement of the coupling end of the tool body from the tool holder.

The press brake tool, further comprising a tang formed on the coupling end of the tool body and adapted for the selective engagement with the tool holder, where the magnetic assembly is configured to generate the magnetic flux coupling between the tang and a magnetic component of the tool holder. The press brake tool, where the magnetic assembly comprises one or more permanent magnets disposed in the tang and configured to generate the magnetic flux coupling with the tool holder through one or both of a top surface and a side surface of the tang. The press brake tool, where the coupling mechanism comprise a magnetic armature configured to modulate the strength of the magnetic flux coupling by relative motion with respect to the one or more permanent magnets. The press brake tool, where the relative motion comprises transverse location of the armature with respect to the one or more permanent magnets. The press brake tool, further comprising a pushbutton type biasing member configured to retain the armature in alternate locked and unlocked positions, where the coupling end of the tool body is selectively engaged with and disengaged from the tool holder, respectively.

The press brake tool, where the relative motion comprises rotation of the magnetic armature with respect to the one or more permanent magnets. The press brake tool, further comprising gear member configured for rotation of the armature between alternate locked and positions, where the coupling end of the tool body is selectively engaged with and disengaged from the tool holder, respectively. The press brake tool, further comprising a pushbutton coupled to the gear member via a rack and pinion assembly and adapted for rotation of the armature thereby.

The press brake tool, further comprising a lever coupled to the armature for rotation thereof. The press brake tool, where the armature comprises transversely oriented magnetic elements configured for selective interaction with corresponding transversely oriented permanent magnets in the tang. The press brake tool, where the transversely permanent magnetics in the tang are adapted to generate the magnetic flux coupling through top surface and the side surface of the tang, respectively.

A machine tool comprising: a first end configured for operation on a workpiece; a second end configured for engagement with a tool holder; a plurality of magnetic elements configured to generate magnetic flux couplings adapted for the engagement of the second end of the tool body with the tool holder; and a coupling mechanism configured to modulate the magnetic flux couplings, where the second end of the tool body is selectively disengaged from the tool holder.

The machine tool, where the coupling mechanism comprises first and second magnetic armatures joined together by a transverse member. The machine tool, where first and second magnetic armatures have transversely oriented magnetic components. The machine tool, where the first and second magnetic armatures are configured for modulating the magnetic flux coupling by selective interaction with different respective permanent magnet elements disposed in the second end of the machine tool. The machine tool, where the different permanent magnet elements are disposed to generate the magnetic flux coupling through a top surface and one or more side surfaces of the second end of the machine tool, respectively.

The machine tool, further comprising a magnetically permeable material disposed adjacent at least one of the magnetic elements and adapted to substantially magnetically isolate the at least one elements from others of the magnetic elements. The machine tool, where the magnetically permeable material is disposed adjacent a first set of the magnetic elements disposed to generate a first component of the magnetic flux couplings through a top surface of the second end of the machine tool, substantially isolated from a second set of the magnetic elements disposed to generate a second component of the magnetic flux couplings through at least one side surface of the second end of the machine tool. The machine tool, further comprising one or more magnetic gaps disposed adjacent at least one of the plurality of magnetic elements, the magnetic gaps adapted to modulate at least one of the magnetic flux couplings by manipulation of the coupling mechanism with respect thereto.

Tool Systems and Methods of Use

Suitable press brake tool systems can include a tool body having a working end configured for operation on a workpiece and a coupling end configured for selective engagement with a tool holder, the working end spaced from the coupling end along the tool body; and one or more magnetic elements configured to induce a magnetic coupling between the tool body and the tool holder, where the coupling end of the tool body is magnetically engageable with the tool holder.

The magnetic elements can include one or more magnets disposed in the tool body for generating magnetic flux to induce the magnetic coupling, one or more ferromagnetic elements disposed in the tool body for guiding magnetic flux to induce the magnetic coupling, or a combination thereof. The magnetic coupling can be sufficient to support a weight of the tool body upon engagement of the coupling end with the tool holder.

The press brake tool systems can include a mechanism configured for selective disengagement of the coupling end of the tool body from the tool holder. The mechanism can comprise an actuator engaged with the tool body, the actuator configured to urge at least a portion of the coupling end from the tool holder to define an air gap therebetween.

The mechanism can comprise a pry bar or lever member engaged with the tool body, the pry bar or lever member extending from a first end to a second end, the second end configured to selectively disengage the coupling end of the tool body from the tool holder upon actuation of the first end. The first end of the pry bar or lever member may be accessible by a user, e.g., with the coupling end of the tool body engaged in the tool holder, and where the second end of the pry bar or lever member is configured to protrude from the tool body to selectively disengage the coupling end of the tool body from the tool holder upon manipulation of the first end by the user. A biasing element can be configured to bias the second end of the pry bar or lever member in a position disposed within the tool body, absent manipulation of the first end.

A load-bearing shoulder can be configured to bear a mechanical load between the tool holder and the tool body upon operation of the working end, where the second end of the pry bar or lever member is configured to protrude from the load-bearing shoulder to selectively disengage the coupling end from the tool holder. A pin or hinge element can be disposed between the first end of the pry bar or lever member and second end of the pry bar or lever member, e.g., where the pry bar or lever member is pivotably engaged with the tool body by the pin or hinge element. In some examples, the pry bar or lever member comprises a longitudinal portion extending from the first end to the pin or hinge element and a transverse portion extending transversely from the longitudinal portion, e.g., between the pin or hinge element and the second end.

The mechanism can comprise a longitudinal shaft or pin member engaged with the tool body, the longitudinal shaft or pin member extending from a first end configured for actuation by a user to a second end configured to selectively disengage the coupling end of the tool body from the tool holder upon actuation of the first end. The longitudinal shaft or pin member may be disposed in sliding engagement with the tool body, e.g., with the second end configured to extend from the tool body to selectively disengage the coupling end from the tool holder upon actuation of the first end.

The mechanism can comprise an armature having one or more magnets or ferromagnetic components configured to modulate a strength of the magnetic coupling by motion with respect to a flux path defined by disposition of the one or more magnetic elements in the tool body. The armature may be configured to rotate the one or more magnets or ferromagnetic components with respect to the flux path, or with respect to the poles of the magnetic elements defining the flux path. The armature may be configured for lateral motion of the one or more magnets or ferromagnetic components with respect to the flux path defined by magnetic assembly. A lever, knob or push button actuator can be engaged with the tool body, and mechanically coupled to the magnetic armature for manipulation of the one or more magnets or ferromagnetic components by the user to modulate the strength of the magnetic coupling. The mechanism may also comprise a plurality of armature members, each having one or more of the magnets or ferromagnetic components configured to modulate the strength of the magnetic coupling by rotational or lateral motion with respect to one or more flux paths defined by disposition of the one or more magnetic elements in the tool body.

The magnetic elements may comprise one or more permanent magnets disposed in the tool body, the one or more permanent magnets configured to form the magnetic coupling between the tool body and the tool holder with the coupling end of the tool body engaged therein. One or more non-ferromagnetic elements may be disposed in the tool body and adapted for modulation of a flux path through the one or more magnetic elements, e.g., where the strength of the magnetic coupling is responsive to the modulation of the flux path.

The one or more magnetic elements may comprise a plurality of magnetic sub-assemblies. Each magnetic sub-assembly may comprise one or more magnets or ferromagnetic elements configured to independently induce a magnetic coupling between the coupling end of the tool body and the tool holder.

A tang can be defined by the coupling end of the tool body, and adapted for the selective engagement with the tool holder. One or more magnets or ferromagnetic elements may be disposed in the tang, and configured to induce the magnetic coupling by generating or guiding magnetic flux between the tang and the tool holder.

A load-bearing shoulder can be defined on the tool body, and configured to bear a mechanical load between the tool holder and the tool body for operation of the working end of the tool body on a workpiece. One or more magnets or ferromagnetic elements may be disposed in the load-bearing shoulder, and configured to induce the magnetic coupling by generating or guiding magnetic flux between the load-bearing shoulder and the tool holder.

Suitable methods of use and operation include disposing a tool body with respect to a tool holder, the tool body having a working end configured for operation on a workpiece, a coupling end spaced from the working end along the tool body, and one or more magnetic elements configured to induce a magnetic coupling; and engaging the working end of tool body with the tool holder, where the magnetic coupling is induced between the tool body and the tool holder. The magnetic elements may comprise one or more permanent magnets disposed in the tool body for generating magnetic flux to induce the magnetic coupling, one or more ferromagnetic elements disposed in the tool body for guiding magnetic flux to induce the magnetic coupling, or a combination thereof. The magnetic flux coupling may be sufficient to support a weight of the tool body upon engagement of the coupling end with the tool holder.

An actuator mechanism may be engaged with the tool body, and operated to selectively disengage the coupling end of the tool body from the tool holder. Operating the actuator mechanism may comprise manipulating a knob, lever or pushbutton device coupled to the tool body, and mechanically engaged with a shaft or lever member configured to urge at least a portion of the coupling end of the tool body from the tool holder to define an air gap therebetween.

Operating the actuator mechanism may comprise manipulating a pry bar or lever pivotally engaged with the tool body, the pry bar or lever configured to selectively disengage at least a portion of the coupling end of the tool body from the tool holder. Operating the actuator mechanism may also comprise accessing a first end of a lever or pry member engaged with the tool body, where the coupling end of the tool body is engaged in the tool holder; and manipulating the first end of the lever or pry member such that a second end of the lever or pry member protrudes from the tool body to selectively disengage the coupling end from the tool holder.

Upon releasing the first end of the lever or pry member, the second end may be biased into a position disposed within the tool body. The second end of the lever or pry member may protrude from a load-bearing shoulder of the tool body upon manipulation of the first end, the load-bearing shoulder configured to bear a mechanical load between the tool holder and the tool body upon operation of the working end.

Operating the actuator mechanism can comprise manipulating a longitudinal shaft in sliding engagement with the tool body. The longitudinal shaft can be configured for urging the coupling end of the tool body from the tool holder, e.g., when manipulated by a user.

Operating the actuator mechanism can comprise manipulating one or more magnetic armatures with respect to a flux path defined by disposition of the one or more magnetic elements in the tool body. Manipulating the one or more magnetic armatures may comprise rotation or lateral motion of one or more magnets or ferromagnetic components with respect to the flux path, or with respect to the poles of the magnetic elements defining the flux path. A lever, knob or push button actuator can be manipulated, e.g., by a user, to provide rotation or lateral motion of the one or more magnetic armatures with respect to the flux path.

Suitable methods include selectively engaging a tang on the coupling end of the tool body with the tool holder, where the magnetic coupling is induced by one or more of the magnetic elements disposed in the tang. Additional methods include selectively engaging a load-bearing shoulder defined on the tool body with the tool holder, where the magnetic coupling is induced by one or more of the magnetic elements disposed in the load-bearing shoulder.

A press brake tool system can include a tool body having a working end configured for operation on a workpiece and a coupling end configured for selective engagement with a tool holder; a magnetic assembly configured to induce a magnetic coupling between the coupling end of the tool body and the tool holder; and a mechanism configured for selective disengagement of the magnetic coupling. The magnetic assembly may comprise one or more magnets disposed in the tool body for generating magnetic flux to induce the magnetic coupling, one or more ferromagnetic elements disposed in the tool body for guiding magnetic flux to induce the magnetic coupling, or a combination thereof. The magnetic coupling may be sufficient to support a weight of the tool body upon engagement of the coupling end with the tool holder.

The mechanism can comprise a pry bar or lever actuator engaged with the tool body, the pry bar or lever actuator configured to urge at least a portion of the coupling end from the tool holder to define an air gap therebetween. The pry bar or lever actuator may comprise a first end accessible by a user and a second end configured to extend from the tool body to selectively disengage the coupling end from the tool holder upon manipulation of the first end by the user.

The pry bar or lever actuator may comprise a longitudinal portion extending from a first end and a transverse portion extending transversely from the longitudinal portion to the second end. A pin or hinge may pivotably engage the pry bar or lever actuator with the tool body. A biasing element may bias the second end of the pry bar or lever actuator within the tool body, absent manipulation of the first end.

A load-bearing shoulder can be configured to bear a mechanical load between the tool holder and the tool body upon operation of the working end. The second end of the pry bar or lever member may protrude from the load-bearing shoulder to selectively disengage the coupling end from the tool holder.

The mechanism can comprise a longitudinal shaft or pin member disposed in sliding engagement with the tool body, and configured for actuation by a user to selectively disengage the coupling end of the tool body from the tool holder. The longitudinal shaft or pin member may comprise a first end mechanically engaged with an actuator and a second end configured to extend from the tool body to selectively disengage the coupling end from the tool holder upon manipulation of the actuator.

The mechanism can comprise one or more magnetic armatures configured to modulate a strength of the magnetic coupling by motion with respect to a flux path defined by the magnetic assembly. The one or more magnetic armatures may each comprise one or more magnets or ferromagnetic components configured for rotation or lateral motion with respect to the flux path, or with respect to the magnetic elements defining the flux path. An actuator may be engaged with the tool body, and mechanically coupled to the one or more magnetic armatures for manipulation of the magnets or ferromagnetic components by a user to modulate the strength of the magnetic coupling.

The magnetic assembly can comprise two or more magnetic subassemblies. The subassemblies may be configured to independently induce two or more respective magnetic couplings between the coupling end of the tool body and the tool holder.

A tang may be defined by the coupling end of the tool body and adapted for the selective engagement with the tool holder, e.g., where the magnetic assembly comprises one or more magnets or ferromagnetic elements disposed in the tang to induce the magnetic coupling between the tang and the tool holder. A load-bearing shoulder may be defined on the tool body to bear a mechanical load between the tool holder and the tool body upon operation of the working end, e.g., where the magnetic assembly comprises one or more magnets or ferromagnetic elements disposed in the load-bearing shoulder to induce the magnetic coupling between the load-bearing shoulder and the tool holder.

While this invention has been described with respect to particular examples and embodiments, changes can be made and substantial equivalents can be substituted in order to adapt these teaching to other configurations, materials and applications, without departing from the spirit and scope of the invention. The invention is not limited to the particular examples that are disclosed, but encompasses all the embodiments that fall with the scope of the claims.

The invention claimed is:

1. A press brake tool comprising:

a tool body having a working end configured for operation on a workpiece and a coupling end configured for selective engagement with a tool holder, the working end spaced from the coupling end along the tool body;

one or more magnetic elements configured to induce a magnetic coupling along a magnetic flux path between the tool body and the tool holder, wherein the coupling end of the tool body is magnetically engageable with the tool holder via the magnetic coupling along the magnetic flux path; and an actuator engaged with the tool body and configured to create a gap in the magnetic flux path, wherein a strength of the magnetic coupling is responsive to modulation of the magnetic flux path by introduction of the gap therein, and wherein the strength of the magnetic coupling decreases as a size of the gap increases for selective disengagement of the coupling end of the tool body from the tool holder.

2. The press brake tool of claim 1, wherein the one or more magnetic elements comprise one or more permanent magnets disposed in the tool body for generating magnetic flux to induce the magnetic coupling along the magnetic flux path, which is sufficient to support a weight of the tool body upon engagement of the coupling end with the tool holder.

3. The press brake tool of claim 1, wherein the actuator is configured to urge at least a portion of the coupling end of the tool body from the tool holder to define the gap as an air gap therebetween.

4. The press brake tool of claim 1, wherein the actuator extends from a first end to a second end, the second end configured to selectively disengage the coupling end of the tool body from the tool holder upon actuation of the first end.

5. The press brake tool of claim 4, wherein the first end of the actuator is accessible by a user with the coupling end of the tool body engaged in the tool holder, and wherein the second end of the actuator is configured to protrude from the tool body to selectively disengage the coupling end of the tool body from the tool holder upon manipulation of the first end by the user in at least one of a vertical up or down direction or a lateral direction.

6. The press brake tool of claim 4, further comprising a biasing element configured to bias the second end of the actuator in a position disposed within the tool body, absent manipulation of the first end.

7. The press brake tool of claim 4, further comprising a load-bearing shoulder configured to bear a mechanical load between the tool holder and the tool body upon operation of the working end, wherein the second end of the actuator is configured to protrude from the load-bearing shoulder to selectively disengage the coupling end from the tool holder.

8. The press brake tool of claim 4, further comprising a pin or hinge element disposed between the first end of the actuator and second end of the actuator, wherein the actuator is pivotably engaged with the tool body by the pin or hinge element.

9. The press brake tool of claim 8, wherein the actuator comprises a longitudinal portion extending from the first end to the pin or hinge element and a transverse portion extending transversely from the longitudinal portion between the pin or hinge element and the second end.

10. The press brake tool of claim 1, wherein the actuator comprises a longitudinal shaft or pin member engaged with the tool body, the longitudinal shaft or pin member extending from a first end configured for actuation by a user to a second end configured to selectively disengage the coupling end of the tool body from the tool holder upon actuation of the first end, or wherein the longitudinal shaft or pin member is disposed in sliding engagement with the tool body and the second end is configured to extend from the tool body to selectively disengage the coupling end from the tool holder upon actuation of the first end.

11. The press brake tool of claim 1, wherein the actuator comprises an armature having one or more magnets or ferromagnetic components configured to modulate the strength of the magnetic coupling by motion with respect to the magnetic flux path defined by disposition of the one or more magnetic elements in the tool body.

12. The press brake tool of claim 11, wherein:

the armature is configured to rotate the one or more magnets or ferromagnetic components with respect to the magnetic flux path or for lateral motion of the one or more magnets or ferromagnetic components with respect to the magnetic flux path; or further comprising a lever, knob or push button engaged with the tool body and mechanically coupled to the armature for manipulation of the one or more magnets or ferromagnetic elements by the user to modulate the strength of the magnetic coupling; or the actuator comprises a plurality of such armature members, each of the armature members having one or more of the magnets or ferromagnetic elements configured to modulate the strength of the magnetic coupling by rotational or lateral motion with respect to one or more such magnetic flux paths defined by disposition of the one or more magnetic elements in the tool body.

13. The press brake tool of claim 1, wherein the one or more magnetic elements comprise one or more permanent magnets disposed in the tool body, the one or more permanent magnets configured to form the magnetic coupling between the tool body and the tool holder with the coupling end of the tool body engaged therein.

14. The press brake tool of claim 1, wherein the actuator is adapted for modulation of the magnetic flux path through the one or more magnetic elements by introduction of the gap as an air gap therein, wherein the strength of the magnetic coupling is responsive to the modulation of the magnetic flux path by the air gap for the selective disengagement of the coupling end of the tool body from the tool holder by gravity or user-assisted removal.

15. The press brake tool of claim 1, wherein the one or more magnetic elements comprise a plurality of magnetic sub-assemblies, each magnetic sub-assembly comprising one or more permanent magnets and ferromagnetic elements configured to independently induce a magnetic coupling between the coupling end of the tool body and the tool holder.

16. The press brake tool of claim 1, further comprising:

a tang defined by the coupling end of the tool body and adapted for the selective engagement with the tool holder; and a load-bearing shoulder defined on the tool body and configured to bear a mechanical load between the tool holder and the tool body for operation of the working end of the tool body on a workpiece;

wherein the one or more magnetic elements comprise one or more permanent magnets disposed in the tang or the load-bearing shoulder and configured to induce the magnetic coupling by inducing a magnetic flux along the magnetic flux path between the tool body and the tool holder.

17. The press brake tool of claim 1, wherein the actuator comprises a lever pivotally engaged with the tool body and configured to selectively disengage at least a portion of the coupling end of the tool body from the tool holder.

18. A method comprising:

disposing a tool comprising an actuator engaged with a tool body with respect to a tool holder, the tool body having a working end configured for operation on a workpiece, a coupling end spaced from the working end along the tool body, and one or more magnetic elements configured to induce a magnetic coupling; and engaging the coupling end of the tool body with the tool holder, wherein the magnetic coupling is induced along a magnetic flux path between the tool body and the tool holder and the actuator is configured to create a gap in the magnetic flux path for selective disengagement of the coupling end of the tool body from the tool holder;

wherein the one or more magnetic elements comprise one or more permanent magnets disposed in the tool body for generating magnetic flux to induce the magnetic coupling; and wherein a strength of the magnetic coupling is sufficient to support a weight of the tool body upon engagement of the coupling end with the tool holder, wherein the strength of the magnetic coupling is responsive to modulation of the magnetic flux path by introduction of the gap therein, and wherein the strength of the magnetic coupling decreases as a size of the gap increases for selective disengagement of the coupling end of the tool body from the tool holder.

19. The method of claim 18, further comprising operating the actuator engaged with the tool body to selectively disengage the coupling end of the tool body from the tool holder; wherein operating the actuator comprises manipulating a knob, lever or pushbutton device coupled to the tool body and mechanically engaged with a shaft or lever member configured to urge at least a portion of the coupling end of the tool body from the tool holder to define the gap as an air gap therebetween.

20. The method of claim 19, wherein operating the actuator comprises:

manipulating a longitudinal shaft in sliding engagement with the tool body, the longitudinal shaft urging the coupling end of the tool body from the tool holder; or manipulating one or more magnetic armatures with respect to the magnetic flux path as defined by disposition of the one or more magnetic elements in the tool body, wherein manipulating the one or more magnetic armatures comprises:

rotation or lateral motion of the one or more permanent magnets with respect to the magnetic flux path; or manipulating a lever, knob or push button to provide rotation or lateral motion of the one or more magnetic armatures with respect to the magnetic flux path.

21. The method of claim 18, wherein the actuator comprises a lever mechanism pivotally engaged with the tool body, the lever mechanism configured to selectively disengage at least a portion of the coupling end of the tool body from the tool holder.

22. The method of claim 21, further comprising one or more steps of:

accessing a first end of the lever mechanism engaged with the tool body, wherein the coupling end of the tool body is engaged in the tool holder;

manipulating the first end of the lever mechanism in at least one of a vertical up or down direction or a lateral direction such that a second end of the lever mechanism protrudes from the tool body to selectively disengage the coupling end from the tool holder;

releasing the first end of the lever mechanism, wherein the second end is biased into a position disposed within the tool body; and the second end of the lever mechanism protruding from a load-bearing shoulder of the tool body upon manipulation of the first end, the load-bearing shoulder configured to bear a mechanical load between the tool holder and the tool body upon operation of the working end.

23. The method of claim 18, further comprising:

selectively engaging a tang on the coupling end of the tool body with the tool holder; and selectively engaging a load-bearing shoulder defined on the tool body with the tool holder, wherein the magnetic coupling is induced by one or more of the magnetic elements disposed in the load-bearing shoulder.

24. A press brake tool comprising:

a tool body having a working end configured for operation on a workpiece and a coupling end configured for selective engagement with a tool holder;

a magnetic assembly configured to induce a magnetic coupling along a magnetic flux path between the coupling end of the tool body and the tool holder; and an actuator engaged with the tool body and configured to create a gap in the magnetic flux path for selective disengagement of the magnetic coupling between the coupling end of the tool body and the tool holder;

wherein the magnetic assembly comprises one or more magnets disposed in the tool body for generating magnetic flux to induce the magnetic coupling, and one or more ferromagnetic elements disposed in the tool body for guiding the magnetic flux to induce the magnetic coupling; and wherein a strength of the magnetic coupling is sufficient to support a weight of the tool body upon engagement of the coupling end with the tool holder, wherein the strength of the magnetic coupling is responsive to modulation of the magnetic flux path by introduction of the gap therein, and wherein the strength of the magnetic coupling decreases as a size of the gap increases for selective disengagement of the coupling end of the tool body from the tool holder.

25. The press brake tool of claim 24, wherein the actuator comprises a pry bar or lever engaged with the tool body, the pry bar or lever configured to urge at least a portion of the coupling end from the tool holder to define the gap as an air gap therebetween, and wherein one or more of:

the pry bar or lever comprises a first end accessible by a user and a second end configured to extend from the tool body to selectively disengage the coupling end from the tool holder upon manipulation of the first end by the user in at least one of a vertical up or down direction or a lateral direction;

the pry bar or lever comprises a longitudinal portion extending from a first end and a transverse portion extending transversely from the longitudinal portion to the second end;

a pin or hinge pivotably engaging the pry bar or lever with the tool body;

a biasing element configured to bias the second end of the pry bar or lever within the tool body, absent manipulation of the first end; and a load-bearing shoulder configured to bear a mechanical load between the tool holder and the tool body upon operation of the working end, wherein the second end of the pry bar or lever member is configured to protrude from the load-bearing shoulder to selectively disengage the coupling end from the tool holder.

26. The press brake tool of claim 24, wherein the actuator comprises:

a longitudinal shaft or pin member disposed in sliding engagement with the tool body and configured for actuation by a user to selectively disengage the coupling end of the tool body from the tool holder, wherein the longitudinal shaft or pin member comprises a first end engaged with a second end configured to extend from the tool body to selectively disengage the coupling end from the tool holder upon manipulation of the actuator;

one or more magnetic armatures configured to modulate the strength of the magnetic coupling by motion with respect to the magnetic flux path as defined by the magnetic assembly, wherein the one or more magnetic armatures each comprises:

one or more of the magnets or ferromagnetic components configured for rotation or lateral motion with respect to the magnetic flux path; and the actuator engaged with the tool body and mechanically coupled to the one or more magnetic armatures for manipulation of one or more of the magnets or ferromagnetic components by a user to modulate the strength of the magnetic coupling.

27. The press brake tool of claim 24, wherein the magnetic assembly comprises two or more magnetic subassemblies configured to independently induce two or more respective magnetic couplings between the coupling end of the tool body and the tool holder; and further comprising:

a tang defined by the coupling end of the tool body and adapted for the selective engagement with the tool holder; and a load-bearing shoulder defined on the tool body to bear a mechanical load between the tool holder and the tool body upon operation of the working end wherein the magnetic subassemblies each comprise one or more of the magnets and ferromagnetic elements disposed in the tang or the load-bearing shoulder to induce a portion of the magnetic coupling between the tool body and the tool holder.

* * * * *